US010443302B2

(12) United States Patent
Huang et al.

(10) Patent No.: US 10,443,302 B2
(45) Date of Patent: Oct. 15, 2019

(54) WINDOW SHADE

(71) Applicant: TEH YOR CO., LTD., Taipei (TW)

(72) Inventors: Chin-Tien Huang, New Taipei (TW); Chien-Lan Huang, New Taipei (TW)

(73) Assignee: TEH YOR CO., LTD., Taipei (TW)

( * ) Notice: Subject to any disclaimer, the term of this patent is extended or adjusted under 35 U.S.C. 154(b) by 186 days.

(21) Appl. No.: 15/638,651

(22) Filed: Jun. 30, 2017

(65) Prior Publication Data

US 2018/0010384 A1 Jan. 11, 2018

Related U.S. Application Data

(60) Provisional application No. 62/358,754, filed on Jul. 6, 2016.

(51) Int. Cl.
*E06B 9/26* (2006.01)
*E06B 9/08* (2006.01)
(Continued)

(52) U.S. Cl.
CPC ..... *E06B 9/26* (2013.01); *E06B 9/08* (2013.01); *E06B 9/40* (2013.01); *E06B 9/56* (2013.01); *A47H 13/00* (2013.01); *E06B 9/00* (2013.01)

(58) Field of Classification Search
CPC ..... E06B 9/08; E06B 9/26; E06B 9/34; E06B 9/40; E06B 9/50; E06B 9/56; E06B 9/78;
(Continued)

(56) References Cited

U.S. PATENT DOCUMENTS 2,029,675 A * 2/1936 Schlamp ..... E06B 9/78 160/121.1
2,220,311 A * 11/1940 Anton ..... E04F 10/0677 242/595.1
(Continued)

FOREIGN PATENT DOCUMENTS

CA 2840366 A1 * 7/2014 ..... E06B 9/42
EP 1331354 A1 * 7/2003 ..... E06B 9/78
(Continued)

OTHER PUBLICATIONS

Search Report from corresponding PCT Patent Application No. PCT/US2017/040235 dated Oct. 24, 2017.
(Continued)

*Primary Examiner* — Catherine A Kelly
*Assistant Examiner* — Candace L Bradford
(74) *Attorney, Agent, or Firm* — Chen Yoshimura LLP

(57) ABSTRACT

A window shade includes a reel and an aperture control module respectively assembled with a head frame, and a panel assembly including transversal vanes respectively connected with two panels. The reel is rotatable to wind and unwind the panel assembly. The aperture control module includes a positioning arm connected with a rubbing roller, and is operable to rotate the rubbing roller relative to the positioning arm and to displace the positioning arm and the rubbing roller between two positions, the rubbing roller being displaced away from a sidewall of the head frame in a first position and pressing the panel assembly against the sidewall in a second position, the rubbing roller being further rotatable relative to the positioning arm in the second position to cause relative sliding between the two panels for switching the panel assembly from a closed state blocking light passage to an open state allowing light passage.

20 Claims, 40 Drawing Sheets

(51) Int. Cl.

| | |
|---|---|
| ***E06B 9/40*** | (2006.01) |
| ***E06B 9/56*** | (2006.01) |
| *A47H 13/00* | (2006.01) |
| *E06B 9/00* | (2006.01) |

(58) Field of Classification Search
CPC . E06B 9/262; E06B 9/322; E06B 9/00; E06B 2009/785; E06B 2009/2435; E06B 2009/2627; A47H 13/00
See application file for complete search history.

(56) References Cited

U.S. PATENT DOCUMENTS

| | | | | |
|---|---|---|---|---|
| 2,723,715 | A * | 11/1955 | Kauffmann | E06B 9/34 160/133 |
| 2005/0039866 | A1* | 2/2005 | Allsopp | E06B 9/42 160/321 |
| 2006/0118251 | A1* | 6/2006 | Miller | E06B 9/78 160/133 |
| 2007/0272368 | A1* | 11/2007 | Hoffmann | E06B 9/323 160/121.1 |
| 2011/0139380 | A1* | 6/2011 | Anthony | E06B 9/34 160/293.1 |
| 2011/0253320 | A1* | 10/2011 | Baugh | E06B 9/262 160/127 |
| 2012/0222828 | A1* | 9/2012 | Kwak | E06B 9/262 160/340 |
| 2014/0262066 | A1* | 9/2014 | Certain | E06B 9/26 160/84.02 |
| 2015/0330144 | A1* | 11/2015 | Jung | E06B 9/42 475/4 |
| 2017/0037679 | A1* | 2/2017 | An | E06B 9/34 |

FOREIGN PATENT DOCUMENTS

| | | | |
|---|---|---|---|
| JP | 2016011578 | A | 1/2016 |
| KR | 100943408 | B1 | 2/2010 |
| KR | 20130117067 | A | 10/2013 |
| WO | 2011/078583 | A2 | 12/2010 |

OTHER PUBLICATIONS

Translation into English for 1) Abstract of WO2011078583 (A2); and 2) Abstract of KR20130117067 (A).
1st Office Action in co-pending Korean Patent Application No. 10-2017-0083030 dated Aug. 22, 2018.

* cited by examiner

WINDOW SHADE

CROSS-REFERENCE TO RELATED APPLICATION(S)

This Application claims priority to U.S. Provisional Application No. 62/358,754 filed on Jul. 6, 2016, the disclosure of which is incorporated herein by reference.

BACKGROUND

1. Field of the Invention

The present invention relates to window shades.

2. Description of the Related Art

Many types of window shades are currently available on the market, such as roller shades, Venetian blinds and honeycomb shades. Conventionally, the window shade is provided with an operating cord that can be actuated to raise and lower the window shade. Certain types of window shades may include a panel assembly having multiple transversal strips that may be adjusted to close or open the panel assembly. This function requires a suitable actuating mechanism provided in the window shade. Usually, window shade products available on the market adopt a design that can open the panel assembly for light passage only after it is lowered to its bottommost position, which may not be convenient to use.

Therefore, there is a need for a window shade that is convenient to operate and address the aforementioned issues.

SUMMARY

A window shade described herein includes a head frame, a reel, a panel assembly and an aperture control module. The reel is pivotally connected with the head frame. The panel assembly is connected with the reel and includes a plurality of transversal vanes respectively connected with a first and a second panel, the reel being rotatable to wind and unwind the panel assembly, and the panel assembly being switchable between an open state for light passage and a closed state blocking light passage by rotating the transversal vanes. The aperture control module is assembled with the head frame, and includes a positioning arm that is pivotally connected with a rubbing roller. The aperture control module is operable to rotate the rubbing roller relative to the positioning arm and to displace the positioning arm and the rubbing roller relative to the head frame between a first and a second position, the rubbing roller being displaced away from a sidewall of the head frame in the first position and pressing the panel assembly against the sidewall in the second position, the rubbing roller being further rotatable relative to the positioning arm in the second position to cause relative sliding between the first and second panels for switching the panel assembly from the closed state to the open state.

DETAILED DESCRIPTION OF THE EMBODIMENTS

Figure 1:
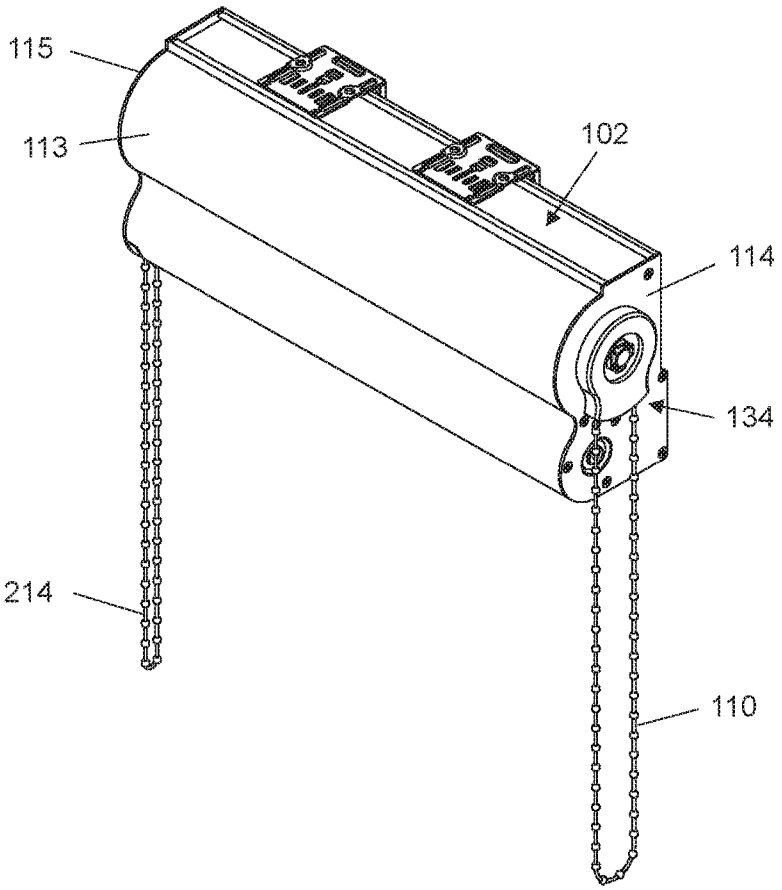
FIG. 1 is a perspective view illustrating an embodiment of a window shade in a fully raised or retracted state.
Figure 2:
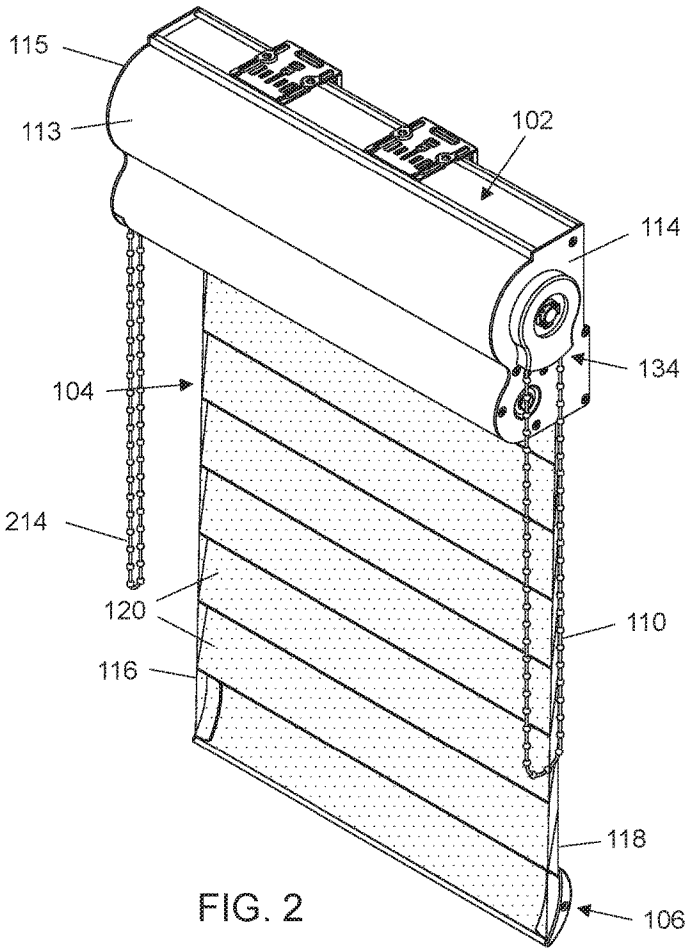
FIG. 2 is a perspective view illustrating the window shade in a lowered and closed state.
Figure 3:
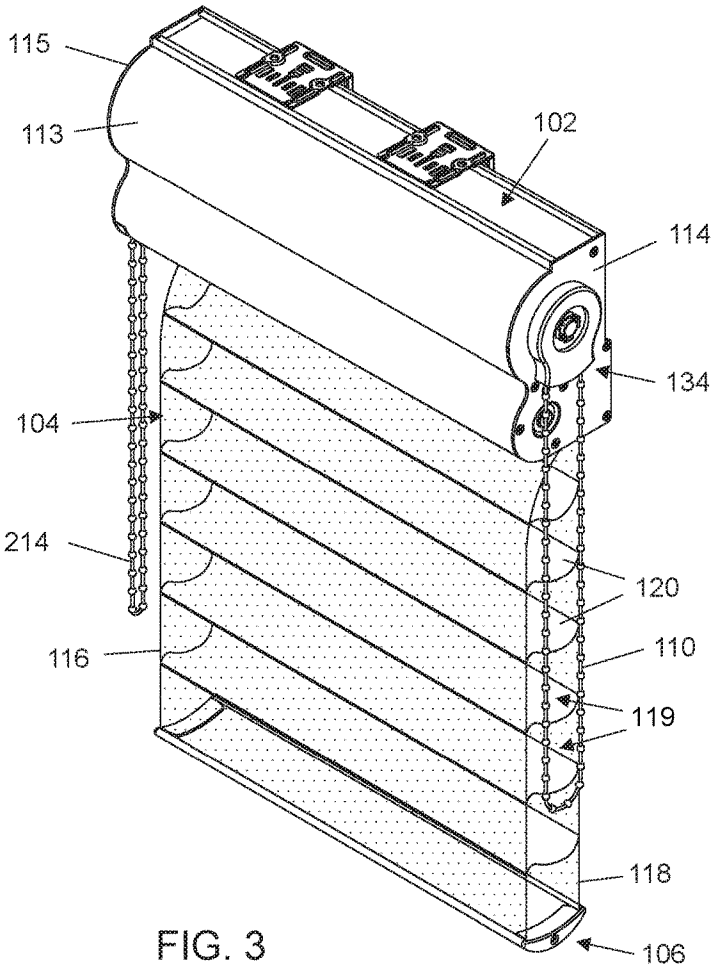
FIG. 3 is a perspective view illustrating the window shade in a lowered and open state.
Figure 4:
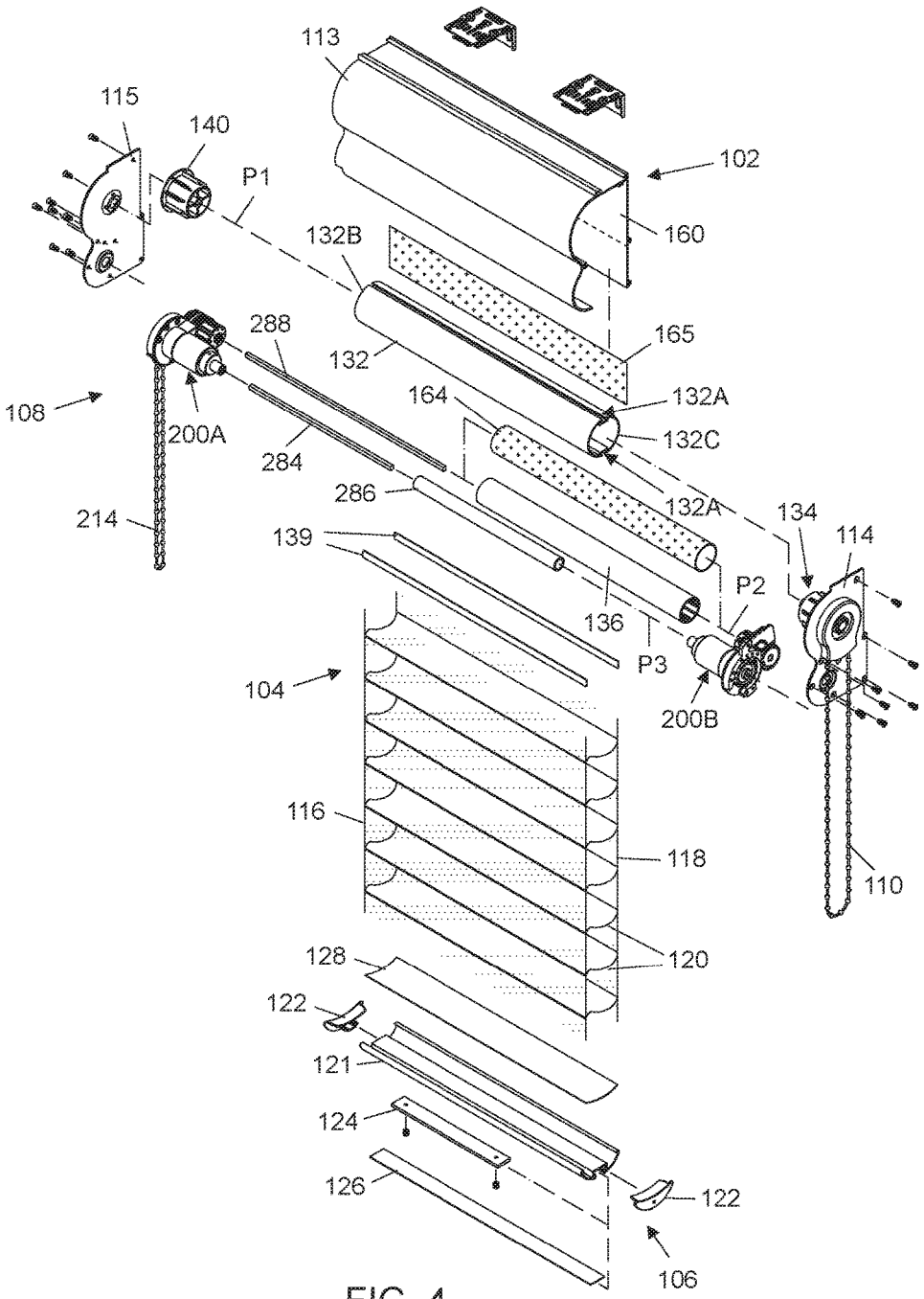
FIG. 4 is an exploded view illustrating a construction of the window shade shown in FIG. 1.

FIGS. 1-3 are perspective views respectively illustrating an embodiment of a window shade 100 in a fully raised or retracted state, a lowered and closed state, and a lowered and open state. FIG. 4 is an exploded view illustrating a construction of the window shade 100. Referring to FIGS. 1-4, the window shade 100 can include a head frame 102, a panel assembly 104, a bottom part 106, and an actuating system 108 including at least two operating members 110 and 214 for controlling the movement of the panel assembly 104.

The head frame 102 may be affixed at a top of a window frame, and may have any desirable shapes. According to an example of construction, the head frame 102 can include a cover 113, and two opposite side caps 114 and 115 respectively connected fixedly with a right and a left end of the cover 113. The head frame 102 can have an inner cavity for at least partially receiving the actuating system 108 of the window shade 100.

The panel assembly 104 can have an upper and a lower end respectively connected with the actuating system 108 and the bottom part 106. The panel assembly 104 can include two panels 116 and 118, and a plurality of parallel transversal vanes 120. Each of the two panels 116 and 118 can have a width extending generally horizontally, and a length perpendicular to the width. The transversal vanes 120 are disposed between the two panels 116 and 118, and are respectively connected with the two panels 116 and 118 along the length of the two panels 116 and 118. According to an example of construction, the two panels 116 and 118 and/or the transversal vanes 120 may be made of flexible materials including, but not limited to, fabric materials, web materials, mesh materials, and the like. In some implementation, the two panels 116 and 118 may exemplary include a transparent or translucent fabric material, and the transversal vanes 120 may include an opaque material. The panel assembly 104 can be retracted toward an interior of the head frame 102, and expanded or lowered outside the head frame 102. When the panel assembly 104 is expanded or lowered outside the head frame 102 at any given height, the panel assembly 104 is further switchable between a closed state and an open state by imparting a relative displacement between the two panels 116 and 118 that rotates the transversal vanes 120. When the panel assembly 104 is in the closed state, the transversal vanes 120 are substantially vertical and vertically overlap with one another for blocking light passage, as shown in FIG. 2. When the panel assembly 104 is in the open state, the transversal vanes 120 can be turned generally horizontally parallel to one another and define a plurality of gaps 119 in the panel assembly 104 for light passage, as shown in FIG. 3. The vertical position of the panel assembly 104 and its switching between the closed and open state may be controlled by the actuating system 108, which will be described hereinafter in more details.

The bottom part 106 is disposed at a bottom of the panel assembly 104 as a weighing structure, and is movable vertically along with the panel assembly 104 as the panel assembly 104 is retracted toward or expanded from the head frame 102. Referring to FIG. 4, the bottom part 106 may exemplary include a rigid rail 121 having an elongate shape, and two opposite end caps 122 respectively attached to a left and a right end of the rigid rail 121. A detachable weighing bar 124 may be fastened to the rigid rail 121 to adjust the weight of the bottom part 106. The weighing bar 124 may be concealed with a cover strip 126. For facilitating the attachment of the bottom part 106 to the panel assembly 104, an example of construction may fixedly connect the two panels 116 and 118 with an attachment strip 128, which in turn is fixedly fastened to the bottom part 106.

Referring to FIGS. 1-4, the actuating system 108 can include a reel 132, a vertical control module 134, a rubbing roller 136, and two aperture control modules 200A and 200B. The reel 132 is pivotally supported inside the head frame 102, and is connected with the panel assembly 104, e.g., with the two panels 116 and 118 of the panel assembly 104. According to an example of construction, an outer circumferential surface of the reel 132 can have two slots 132A at two spaced-apart angular positions, and the two panels 116 and 118 can be respectively attached to two elongate strips 139 that are respectively inserted into the two slots 132A for anchoring the panel assembly 104 with the reel 132. Depending on the direction of rotation of the reel 132, the panel assembly 104 can wind around the reel 132 for retraction toward the head frame 102, or unwind from the reel 132 to expand and lower below the head frame 102. The panel assembly 104 can be wound around the reel 132 with the panel 116 at an inner side and the other panel 118 at an outer side. The panels 116 and 118 can respectively correspond to a front and a rear panel when the window shade 100 is installed in a room, the front panel facing an interior of the room, and the rear panel being behind the front panel.

The reel 132 is pivotally connected with the head frame 102 about a pivot axis P1 that extends along the head frame 102. According to an example of construction, the reel 132 may be disposed inside the head frame 102 with an end 132B of the reel 132 fixedly attached to a coupling plug 140, and the coupling plug 140 in turn is pivotally connected with the side cap 115 of the head frame 102. The other end 132C of the reel 132 can be rotationally coupled to the vertical control module 134, which is assembled adjacent to the other side cap 114 of the head frame 102. The vertical control module 134 is operable to drive the reel 132 in rotation about the pivot axis P1 relative to the head frame 102 for winding and unwinding the panel assembly 104.

Figure 5:
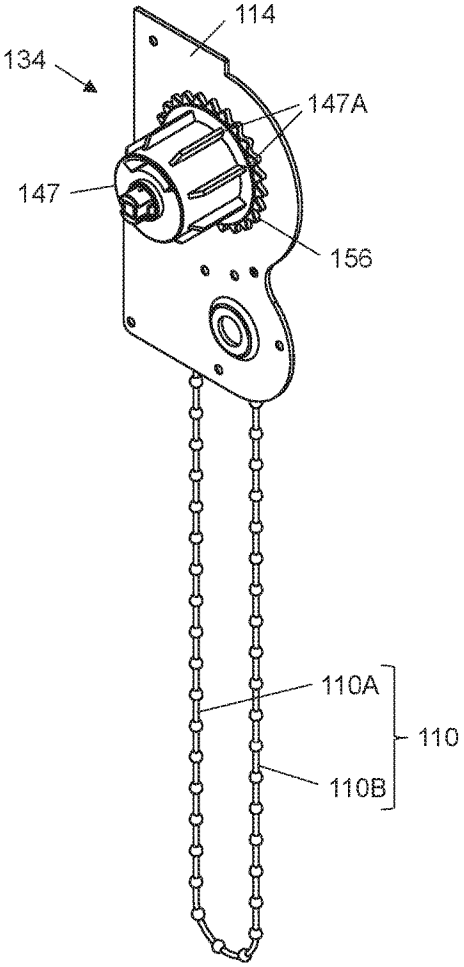
FIG. 5 is a perspective view illustrating a construction of a vertical control module provided in the window shade.
Figure 6:
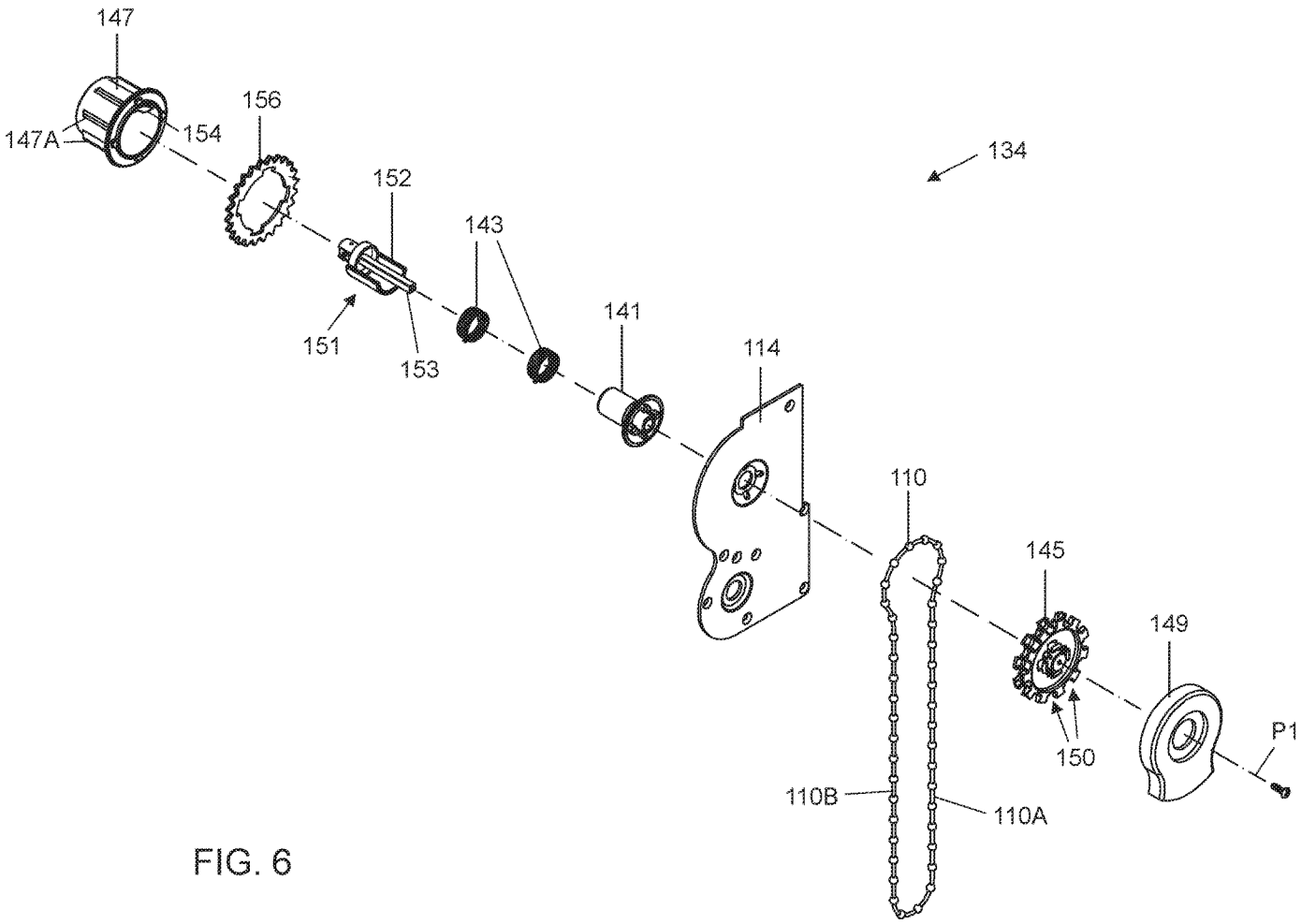
FIG. 6 is an exploded view of the vertical control module.
Figure 7:
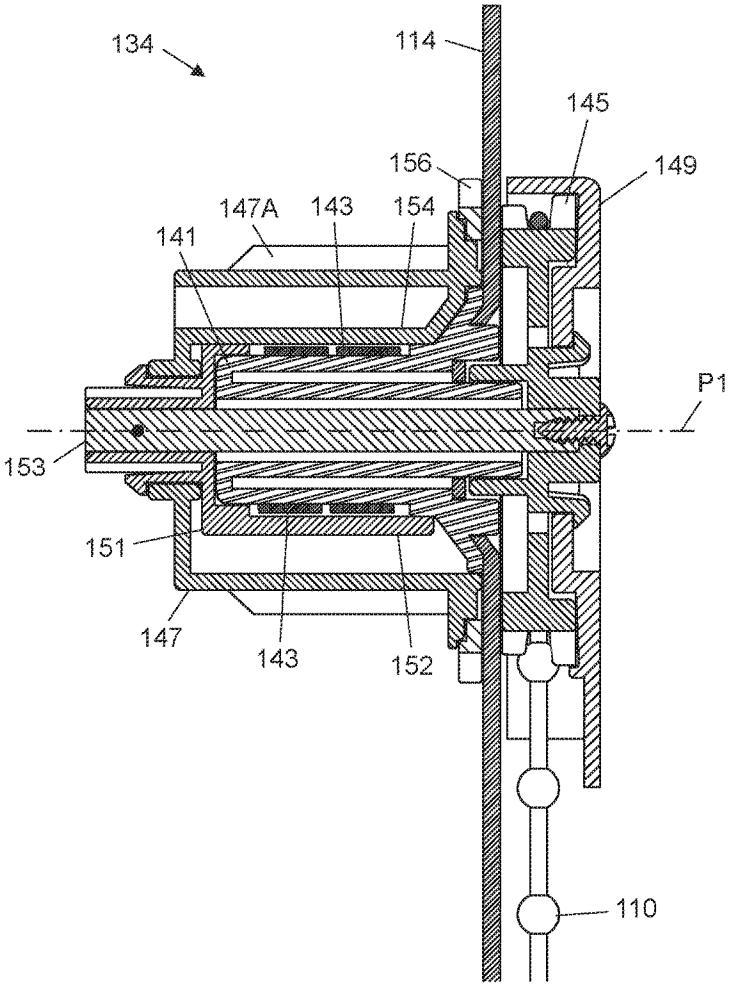
FIG. 7 is a cross-sectional view illustrating an assembly of the vertical control module taken in a section plane along a pivot axis of the vertical control module.
Figure 8:
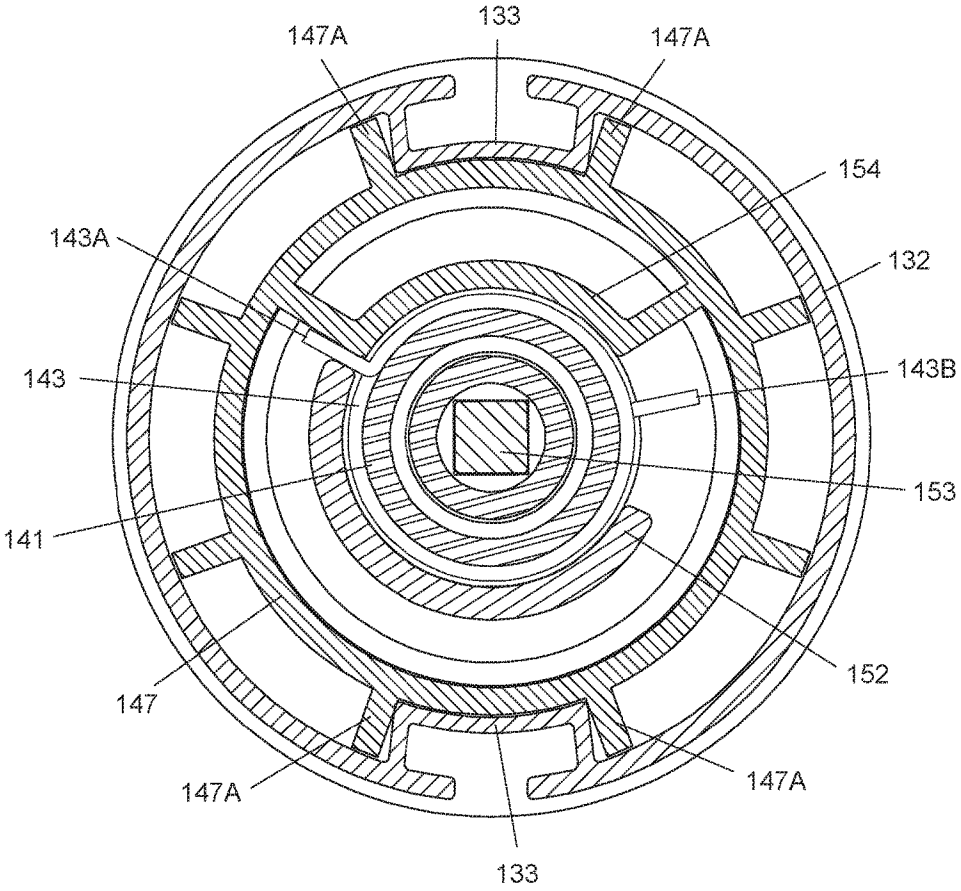
FIG. 8 is a cross-sectional view illustrating the assembly of the vertical control module taken in a section plane perpendicular to the pivot axis of the vertical control module.

In conjunction with FIG. 4, FIGS. 5 and 6 are respectively a perspective and an exploded view illustrating a construction of the vertical control module 134, and FIGS. 7 and 8 are two cross-sectional views respectively taken in a section plane along the pivot axis P1 and a section plane perpendicular to the pivot axis P1 illustrating the assembly of the vertical control module 134. Referring to FIGS. 4-8, the vertical control module 134 can include the operating member 110, a fixed shaft member 141, one or more spring 143, a sprocket wheel 145, a reel connector 147 and a casing 149. The fixed shaft member 141 can be fixedly attached to the side cap 114 of the head frame 102 coaxial to the pivot axis P1 of the reel 132.

Each spring 143 can be a coiled spring. Each spring 143 can be assembled around the fixed shaft member 141 in tight contact therewith, and can have two prongs 143A and 143B spaced apart from each other. Each of the two prongs 143A and 143B can be respectively pushed in one direction for causing the spring 143 to expand and loosen with respect to the fixed shaft member 141, and in an opposite direction for causing the spring 143 to further contract and tighten on the fixed shaft member 141.

The sprocket wheel 145 can have a hole through which is disposed the fixed shaft member 141 so that the sprocket wheel 145 is pivotally supported by the fixed shaft member 141 for rotation about the pivot axis P1. The sprocket wheel 145 may have a circumference configured to engage with the operating member 110. In the illustrated embodiment, the operating member 110 is exemplary a bead chain, and the circumference of the sprocket wheel 145 may include a plurality of notches 150 that can engage with the bead chain. Pulling on the operating member 110 thus can drive the sprocket wheel 145 to rotate in either direction. For example, the operating member 110 may have an outer portion 110A and an inner portion 110B, and pulling downward one of the outer and inner portions 110A and 110B may drive the sprocket wheel 145 to rotate in one direction while pulling downward the other one of the outer and inner portions 110A and 110B may drive the sprocket wheel 145 to rotate in an opposite direction.

The sprocket wheel 145 can further be fixedly connected with an actuating part 151, which can have a tongue 152 that wraps partially around the fixed shaft member 141. For example, the actuating part 151 may include a shaft portion 153 having a polygonal cross-section that is inserted into and fixedly fastened to the sprocket wheel 145 via a screw.

The sprocket wheel 145 and the actuating part 151 are thereby rotationally coupled to each other. The tongue 152 of the actuating part 151 may extend partially around a first region of the spring 143 such that a rotation of the sprocket wheel 145 in either direction can result in the tongue 152 of the actuating part 151 selectively pushing against one of the two prongs 143A and 143B for causing the spring 143 to expand and loosen. For example, the tongue 152 of the actuating part 151 can push against the prong 143A of the spring 143 for causing the spring 143 to loosen when the sprocket wheel 145 rotates in a first direction, and the tongue 152 of the actuating part 151 can push against the prong 143B of the spring 143 for causing the spring 143 to loosen when the sprocket wheel 145 rotates in a second direction opposite to the first direction.

Referring again to FIGS. 4-8, the reel connector 147 can be rotationally coupled to the reel 132, and can have an opening through which is disposed the fixed shaft member 141 so that the reel connector 147 is pivotally supported by the fixed shaft member 141 for rotation about the pivot axis P1. According to an example of construction, the reel connector 147 can be provided as a plug which may be inserted into the reel 132, an outer surface of the reel connector 147 being provided with a plurality of teeth 147A that may be engaged with inner teeth 133 provided inside the reel 132 for rotationally coupling the reel connector 147 to the reel 132. The reel connector 147 and the reel 132 thus can rotate in unison for winding and unwinding the panel assembly 104.

Referring to FIGS. 6 and 8, the reel connector 147 can further have an inner side provided with a rib 154 having two opposite edges. According to an example of construction, the rib 154 can be formed integrally with the reel connector 147. The reel connector 147 can be disposed with the rib 154 extending partially around a second region of the spring 143 and capable of selectively pushing against either of the two prongs 143A and 143B for causing the spring 143 to contract and tighten on the fixed shaft member 141.

Referring to FIG. 5-7, the vertical control module 134 can further include a toothed part 156 that is connected with the reel connector 147. According to an example of construction, the toothed part 156 may have a generally circular circumference provided with projecting teeth. The connection between the toothed part 156 and the reel connector 147 is such that they are rotatable in unison in either direction. Accordingly, the toothed part 156 can be rotationally coupled to the reel 132.

Referring again to FIGS. 4-7, the casing 149 can be affixed with the head frame 102, and can enclose at least partially the sprocket wheel 145 and the actuating part 151 with the operating member 110 extending outside the casing 149 and the head frame 102. The reel connector 147 and the toothed part 156 can be exposed outside the casing 149.

For lowering the panel assembly 104, a user can pull downward one of the outer portion 110A and the inner portion 110B of the operating member 110 (e.g., the outer portion 110A), which urges the sprocket wheel 145 to rotate in a first direction and cause the actuating part 151 to push against one of the two prongs 143A and 143B for causing the spring 143 to expand and loosen. The loosened spring 143 then can rotate along with the sprocket wheel 145 and push against the rib 154 of the reel connector 147, which consequently causes the reel connector 147, the reel 132 and the toothed part 156 to rotate in unison in the same direction along with the spring 143 and the sprocket wheel 145 for unwinding and lowering the panel assembly 104.

For raising the panel assembly 104, a user can pull downward the other one of the outer portion 110A and the inner portion 110B of the operating member 110 (e.g., the inner portion 110B), which urges the sprocket wheel 145 to rotate in an opposite second direction and cause the actuating part 151 to push against the other one of the two prongs 143A and 143B for causing the spring 143 to expand and loosen. The loosened spring 143 then can likewise rotate along with the sprocket wheel 145 and push against the rib 154, which consequently causes the reel connector 147, the reel 132 and the toothed part 156 to rotate in unison in the same direction along with the spring 143 and the sprocket wheel 145 for winding and raising the panel assembly 104.

When the operating member 110 is not operated and the sprocket wheel 145 remains stationary (e.g., when the panel assembly 104 is positioned at a desired height), the suspended weight of the panel assembly 104 and the bottom part 106 can apply a torque on the reel 132 and the reel connector 147, which biases the rib 154 to push against one of the two prongs 143A and 143B of the spring 143 for causing the spring 143 to contract and tighten on the fixed shaft member 141. While the rib 154 remains in contact against one of the two prongs 143A and 143B, the tightening action of the spring 143 on the fixed shaft member 141 can block rotation of the spring 143, the reel connector 147 and the reel 132 about the pivot axis P1 and keep the panel assembly 104 and the bottom part 106 at any desirable positions, such as the different positions shown in FIGS. 1-3.

Figure 10:
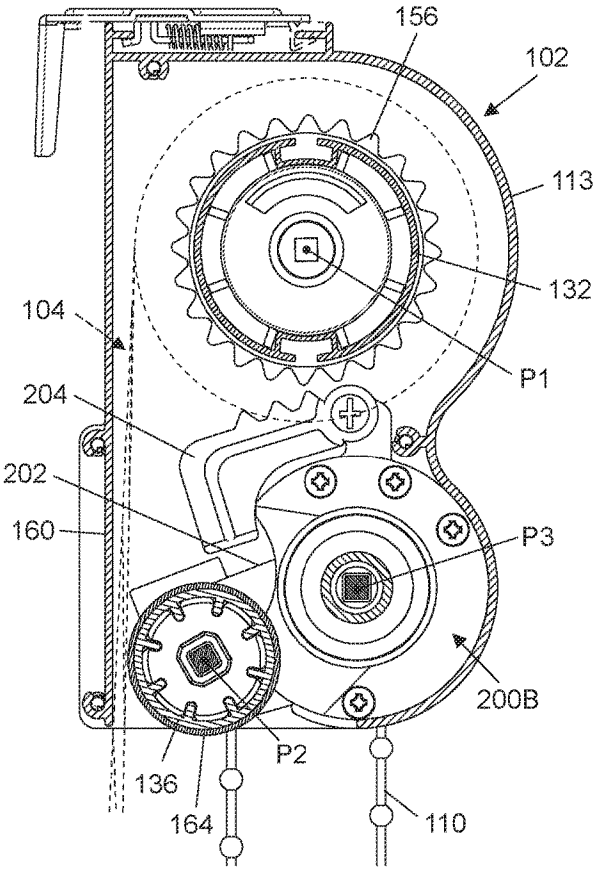
FIGS. 9 and 10 are two cross-sectional views respectively illustrating two aperture control modules provided in the window shade in a configuration corresponding to the closed state of the panel assembly.
Figure 9:
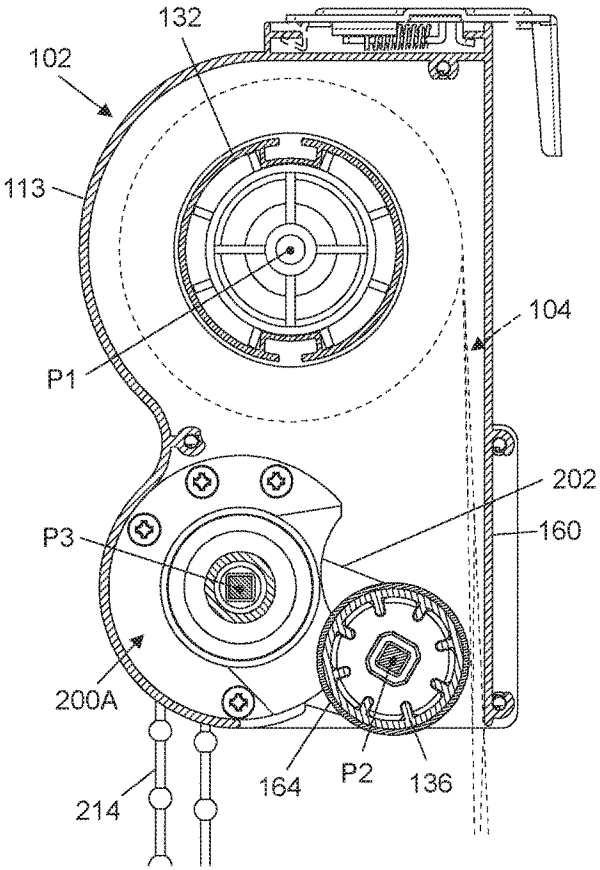
Figure 12:
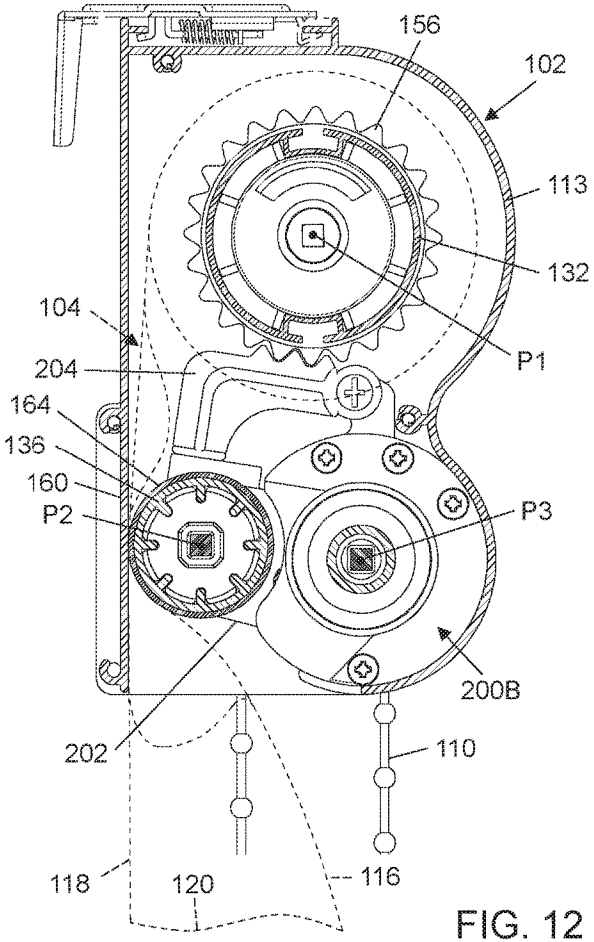
FIGS. 11 and 12 are two cross-sectional views respectively illustrating the two aperture control modules of the window shade in a configuration corresponding to the open state of the panel assembly.
Figure 11:
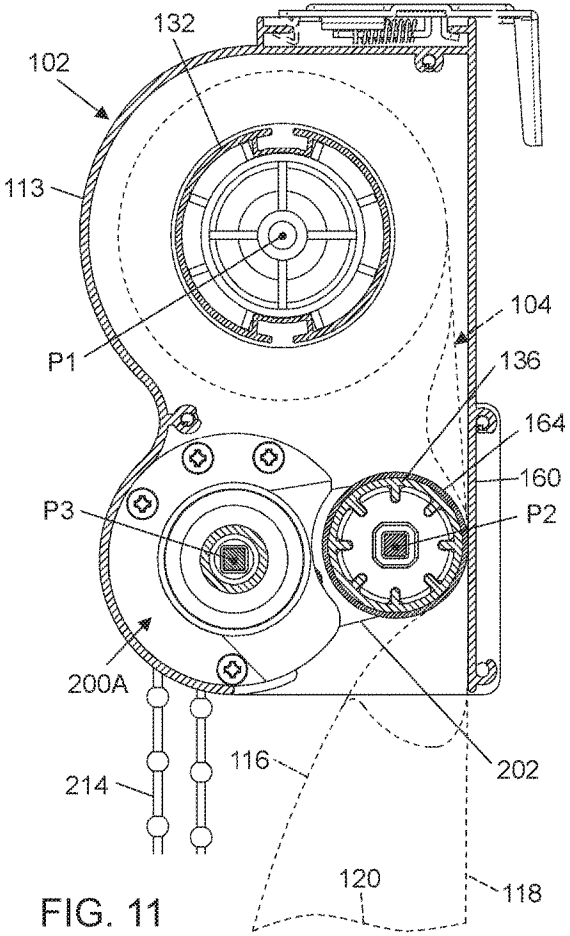

In conjunction with FIGS. 1-4, FIGS. 9-12 are cross-sectional views illustrating exemplary operation of the rubbing roller 136 and the two aperture control modules 200A and 200B for switching the panel assembly 104 between the closed state and the open state. More specifically, FIGS. 9 and 10 are two cross-sectional views respectively illustrating the aperture control modules 200A and 200B in a configuration corresponding to the closed state of the panel assembly 104, and FIGS. 11 and 12 are two cross-sectional views respectively illustrating the aperture control modules 200A and 200B in another configuration corresponding to the open state of the panel assembly 104.

Referring to FIGS. 1-4 and 9-12, the rubbing roller 136 can be movably supported by the two aperture control modules 200A and 200B, which are assembled with the head frame 102 and are respectively connected with two opposite ends of the rubbing roller 136. More specifically, each of the two aperture control modules 200A and 200B can respectively include a positioning arm 202 that is pivotally connected with the rubbing roller 136 about a pivot axis P2. The positioning arms 202 may be pivotally assembled in the head frame 102 so as to be rotatable about a pivot axis P3 relative to the head frame 102. The two aperture control modules 200A and 200B are operable independently from the vertical control module 134 to rotate the rubbing roller 136 relative to the positioning arms 202, and to displace the positioning arms 202 and the rubbing roller 136 relative to the head frame 102 between a first or release position shown in FIGS. 9 and 10 and a second or squeezing position shown in FIGS. 11 and 12.

In the release position of FIGS. 9 and 10, the rubbing roller 136 is displaced away from a sidewall 160 of the head frame 102, so that the panel assembly 104 can move without obstruction through a gap between the rubbing roller 136 and the sidewall 160 for vertical adjustment. This release position of the rubbing roller 136 corresponds to the closed state of the panel assembly 104.

In the squeezing position of FIGS. 11 and 12, the rubbing roller 136 is raised upward from the release position and presses the panel assembly 104 against the sidewall 160 of the head frame 102. The panel assembly 104 is thereby squeezed between the rubbing roller 136 and the sidewall 160 of the head frame 102 with the panels 116 and 118 respectively in contact with the rubbing roller 136 and the sidewall 160. While the positioning arms 202 and the rubbing roller 136 are maintained in the squeezing position, the aperture control modules 200A and 200B are further operable to drive the rubbing roller 136 in rotation relative to the positioning arms 202 in a direction that urges the panel 116 to slide upward relative to the panel 118. This relative sliding displacement between the two panels 116 and 118 can rotate the transversal vanes 120 to switch the panel assembly 104 from the closed state to the open state.

To increase the frictional contact with the panels 116 and 118, an outer surface of the rubbing roller 136 and the sidewall 160 may be respectively covered with friction materials 164 and 165 (better shown in FIG. 4). The friction materials 164 and 165 may include, without limitation, rubber. The friction material 164 may be provided in the form of a sleeve or a pad that can cover at least partially the rubbing roller 136, and the friction material 165 may be a pad that can cover at least partially the sidewall 160.

According to some embodiments, the aperture control modules 200A and 200B are operable to displace the positioning arms 202 relative to the head frame 102 and rotate the rubbing roller 136 relative to the positioning arms 202 in a concurrent manner. For example, the rubbing roller 136 can rotate in one direction while the positioning arms 202 move from the release position of FIGS. 9 and 10 to the squeezing position of FIGS. 11 and 12, and in an opposite direction while the positioning arms 202 move from the squeezing position to the release position. Moreover, the rubbing roller 136 can rotate in one direction while the positioning arms 202 are displaced from the release position to the squeezing position, and further rotate in the same direction while the positioning arms 202 remain in the squeezing position for switching the panel assembly 104 from the closed state to the open state. Conversely, the rubbing roller 136 can rotate in an opposite direction while the positioning arms 202 are displaced from the squeezing position to the release position for switching the panel assembly 104 from the open state to the closed state.

Referring again to FIGS. 1-4 and 9-12, a safety lock 204 may be provided adjacent to one of the two aperture control modules 200A and 200B. For example, the safety lock 204 may be pivotally assembled adjacent to the aperture control module 200B which is disposed close to the vertical control module 134. When the positioning arm 202 of the aperture control module 200B moves from the release position to the squeezing position for switching the panel assembly 104 to the open state, the positioning arm 202 can contact and urge the safety lock 204 to rotate upward, which thereby brings the safety lock 204 in engagement with the toothed part 156 to block rotation of the reel 132. As a result, the vertical aperture module 134 can be blocked to prevent undesirable vertical displacement of the panel assembly 104 in the open state. Moreover, a movement of the positioning arm 202 from the squeezing position to the release position for switching the panel assembly 104 to the closed state allows the safety lock 204 to rotate downward (e.g., by gravity action) and disengage from the toothed part 156 for rotation of the reel 132. Vertical adjustment of the panel assembly 104 is thereby allowed when it is in the closed state.

Figure 13:
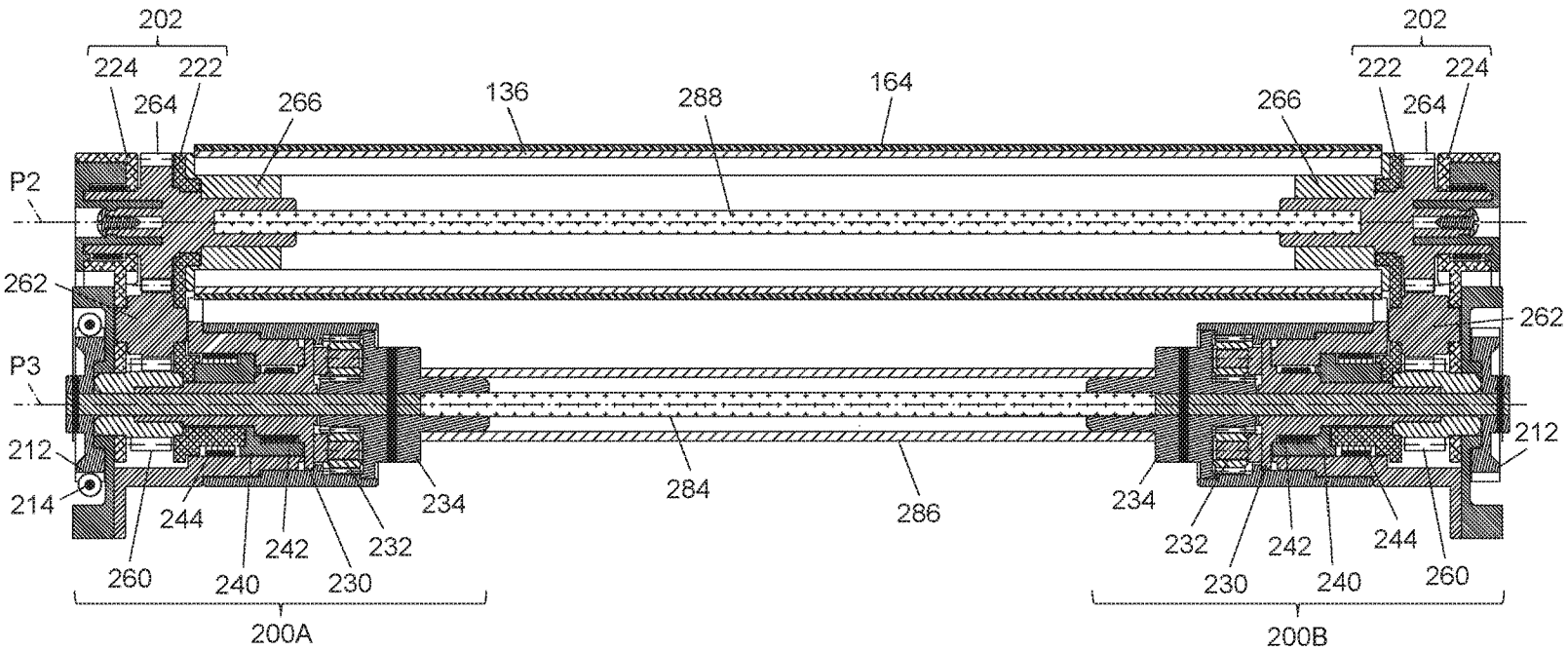
FIG. 13 is a cross-sectional view illustrating the assembly of the two aperture control modules and a rubbing roller.
Figure 15:
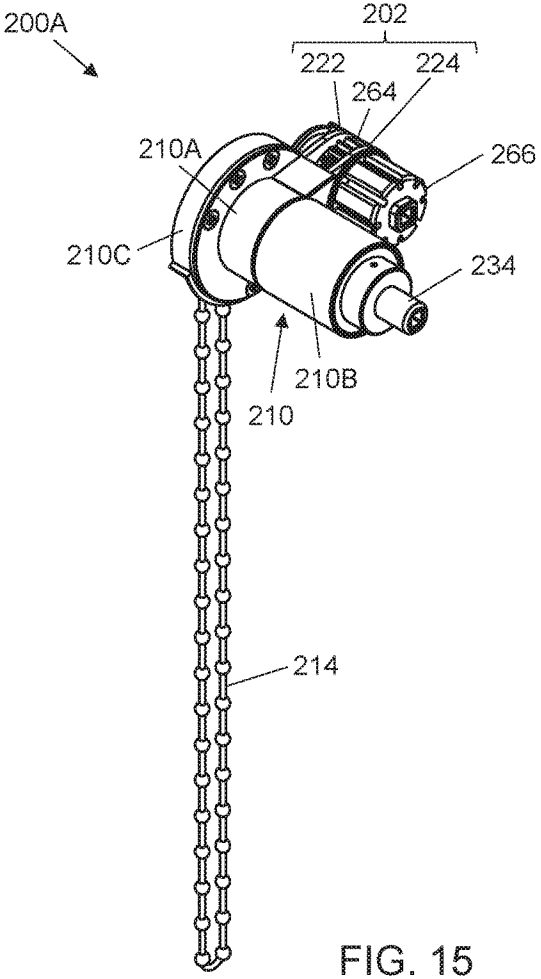
FIGS. 14 and 15 are two perspective views illustrating one of the two aperture control modules.
Figure 14:
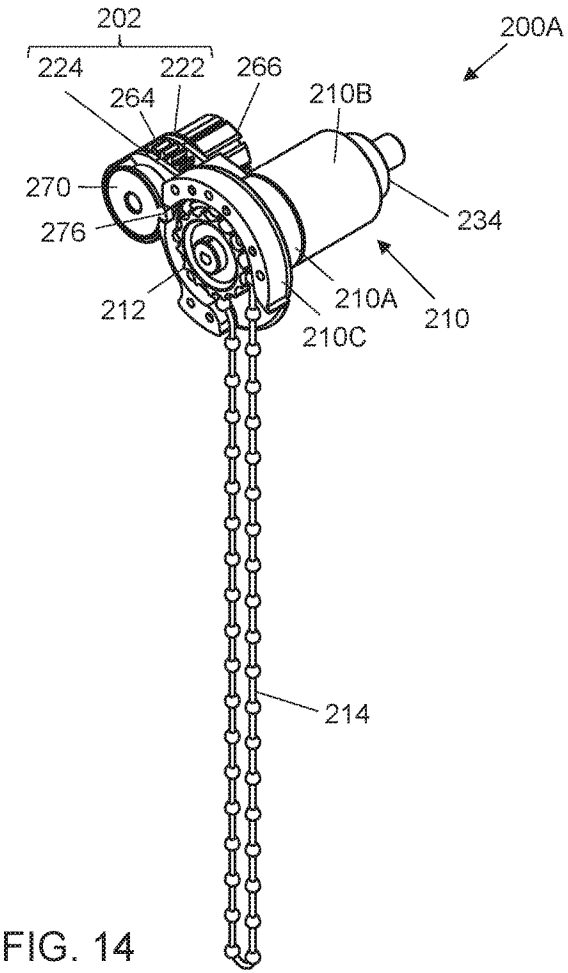
Figure 16:
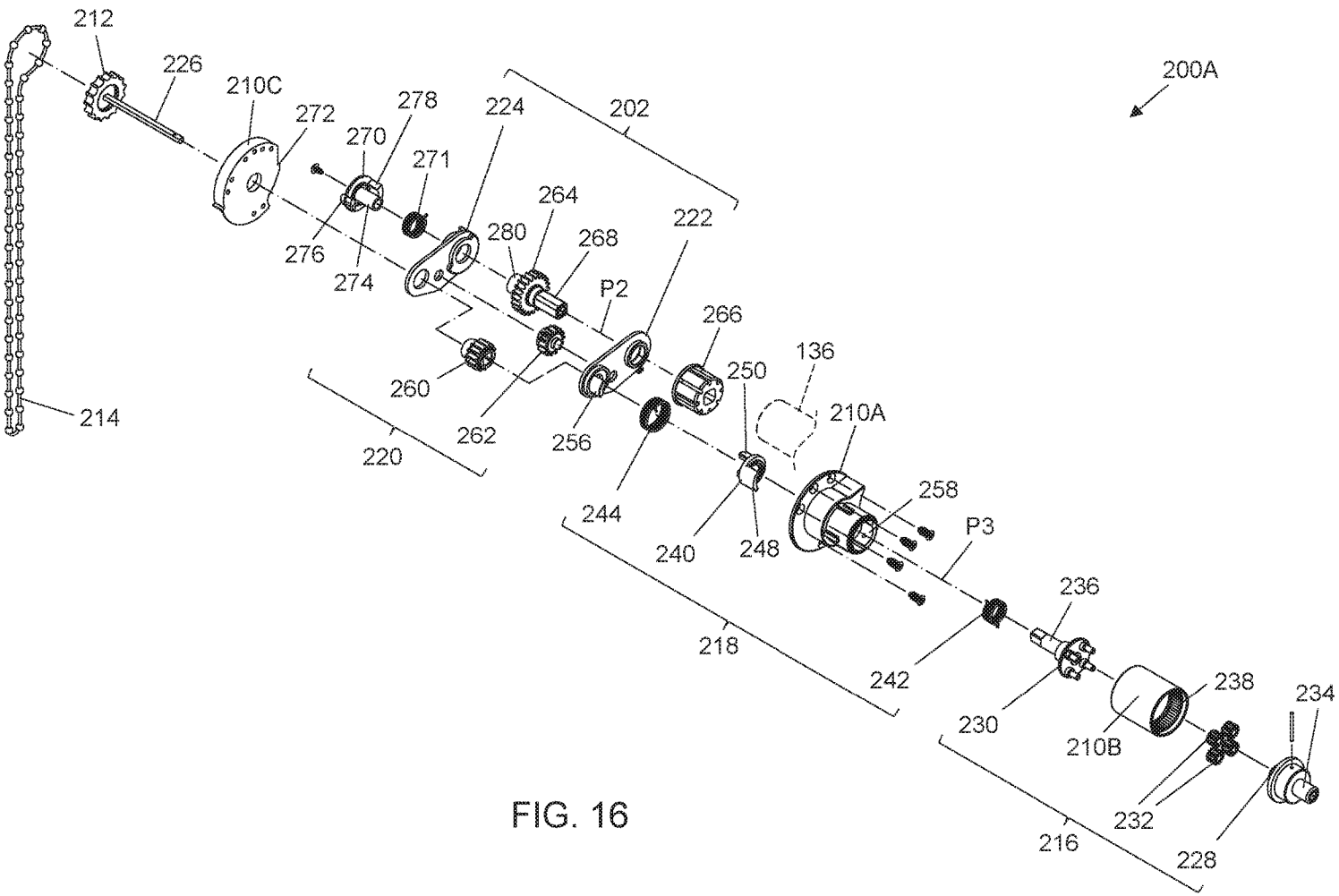
FIG. 16 is an exploded view of the aperture control module shown in FIGS. 14 and 15.
Figure 17:
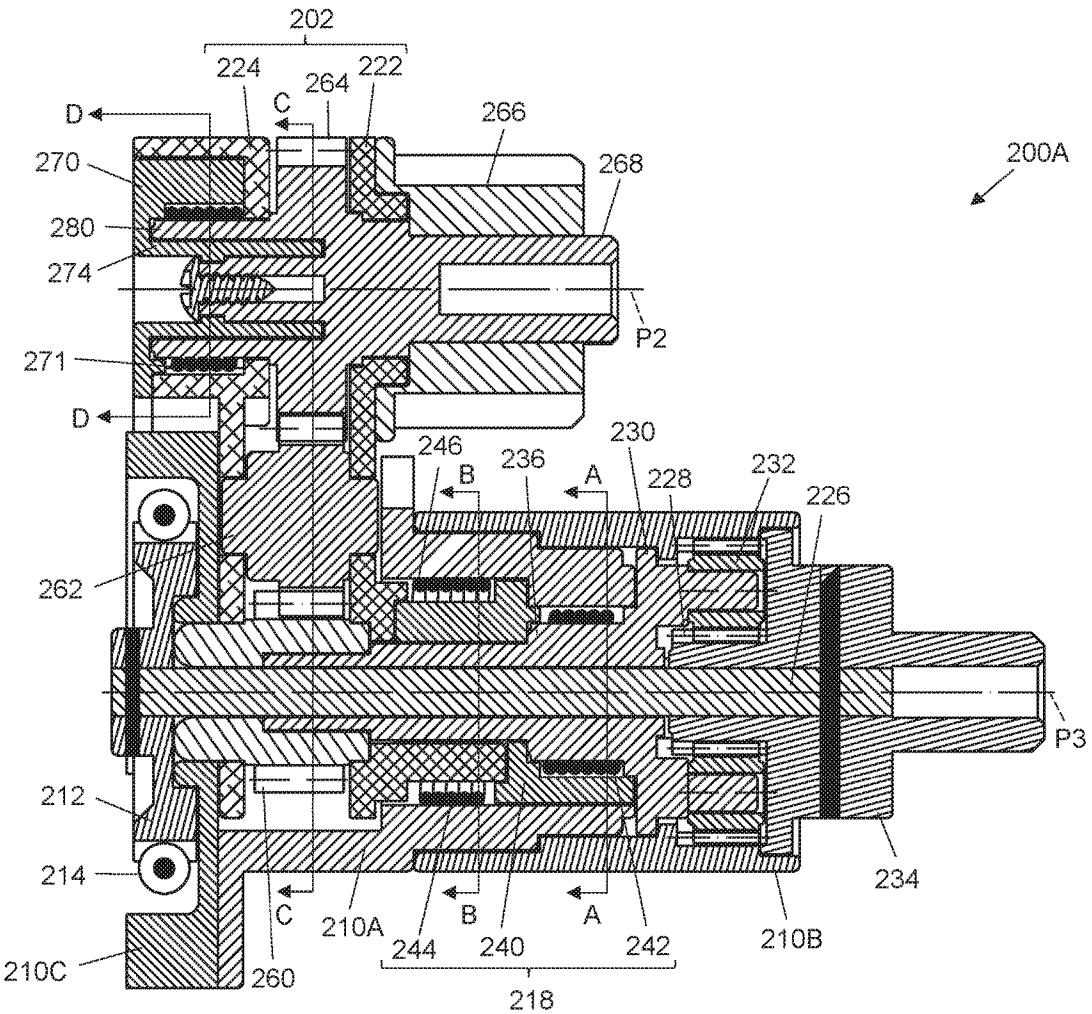
FIG. 17 is a cross-sectional view of the aperture control module shown in FIGS. 14 and 15.

In conjunction with FIGS. 1-4 and 9-12, reference is made hereinafter to FIGS. 13-24 to describe the construction and assembly of the two aperture control modules 200A and 200B. More specifically, FIG. 13 is a cross-sectional view illustrating the assembly of the two aperture control modules 200A and 200B and the rubbing roller 136, FIGS. 14 and 15 are two perspective views illustrating the aperture control module 200A, and FIGS. 16 and 17 are respectively an exploded view and a cross-sectional view of the aperture control module 200A.

Referring to FIGS. 4 and 13-17, the aperture control module 200A can be disposed adjacent to the side cap 115 at an end of the head frame 102 opposite to the end of the head frame 102 where is assembled the vertical control module 134. The aperture control module 200A can include one positioning arm 202, a housing 210, a rotary part 212, the operating member 214, a speed reducer 216, an arm actuating assembly 218 and a gear train 220. The housing 210 can be fixedly connected with the head frame 102, e.g., with the side cap 115. According an example of construction, the housing 210 can include three housing portions 210A, 210B and 210C that are fixedly attached to one another. The housing 210 can define a hollow interior for receiving at least partially the assembly of the positioning arm 202, the rotary part 212, the speed reducer 216, the arm actuating assembly 218 and the gear train 220.

The positioning arm 202 can be pivotally connected with the housing 210 about the pivot axis P3. According to an example of construction, the positioning arm 202 can be pivotally supported by the housing 210 between the two housing portions 210A and 210C, and can be formed by the assembly of two parallel rigid plates 222 and 224.

The rotary part 212 can be pivotally connected with the housing 210, and can be connected with the operating member 214. According to an embodiment, the rotary part 212 can be a sprocket wheel, and the operating member 214 can be a bead chain meshed with the sprocket wheel. The rotary part 212 may be pivotally connected with the housing portion 210C about the pivot axis P3, coaxial to the positioning arm 202. The operating member 214 can extend outside the housing 210 and the head frame 102 for manual operation.

The speed reducer 216 can be assembled through the housing portion 210B, and can be coupled to the rotary part 212 via a linking shaft 226 extending along the pivot axis P3. According to an example of construction, the speed reducer 216 and the rotary part 212 may be respectively disposed at two opposite sides of the positioning arm 202. The speed reducer 216 can include a planetary gear train comprised of a central gear 228, and a carrier 230 pivotally supporting a plurality of planetary gears 232. The central gear 228 may be fixedly connected with a coupling mount 234, which is fixedly attached to the linking shaft 226. The rotary part 212 and the central gear 228 are thereby rotationally coupled to each other and can rotate in unison. The carrier 230 can be pivotally supported about the pivot axis P3, and can be fixedly connected with a shaft portion that forms an output shaft 236 of the speed reducer 216. The carrier 230 can have a hollow interior through which passes the linking shaft 226. The planetary gears 232 are respectively connected pivotally with the carrier 230, and are received in the housing portion 210B. The planetary gears 232 are respectively meshed with the central gear 228 and inner teeth 238 that are provided inside the housing portion 210B surrounding the planetary gears 232. With this assembly, the speed reducer 216 can convert a drive speed provided by the rotary part 212 to a reduced drive speed at the output shaft 236 of the speed reducer 216. For example, the output shaft 236 may rotate 1 turn when the rotary part 212 has completed 2.5 turns. It will be understood that this is a non-limiting example, and other reduction ratios may be applicable.

Referring to FIGS. 16 and 17, the arm actuating assembly 218 can be connected with the output shaft 236 of the speed reducer 216, and can be arranged so as to be rotatable about the pivot axis P3 of the positioning arm 202. According to an embodiment, the arm actuating assembly 218 can include an actuator 240 and two springs 242 and 244, all of which can be assembled coaxial to the pivot axis P3 of the positioning arm 202 with the linking shaft 226 passing through the arm actuating assembly 218 and the carrier 230. In conjunction with FIGS. 16 and 17, FIGS. 18 and 19 are two schematic views respectively illustrating the springs 242 and 244 of the arm actuating assembly 218. Referring to FIGS. 16-19, the springs 242 and 244 can be coiled springs. The spring 242 can have two spaced-apart prongs 242A and 242B, and can be assembled around the output shaft 236 in tight contact therewith. The spring 244 can have two spaced-apart prongs 244A and 244B, and can be assembled in a cavity of the housing 210 (e.g., inside the housing portion 210A) adjacent to the positioning arm 202, an outer circumference of the spring 244 tightly contacting with an inner wall 246 of the cavity.

The actuator 240 can be disposed between the two springs 242 and 244, and can be pivotally supported around the pivot axis P3 of the positioning arm 202. According to an example of construction, the actuator 240 may be formed as a single part. The actuator 240 can have two tongues 248 and 250 that protrude in opposite directions. The tongue 248 can be disposed in a space 252 (better shown in FIG. 18) between the two prongs 242A and 242B of the spring 242, and the tongue 250 can be disposed in a space 254 (better shown in FIG. 19) between the two prongs 244A and 244B of the spring 244. With this assembly, a pressure contact between the actuator 240 and either of the two prongs 242A and 242B of the spring 242 would urge the spring 242 to further contract and tighten around the output shaft 236 of the speed reducer 216, and a pressure contact between the actuator 240 and either of the two prongs 244A and 244B of the spring 244 would urge the spring 244 to contract and loosen with respect to the inner wall 246 of the housing 210.

The actuator 240 and the two springs 242 and 244 are rotatable in unison contacting with one another for urging the positioning arm 202 to rotate between the release position shown in FIG. 9 and the squeezing position shown in FIG. 11. In particular, the actuator 240 is rotatable in either direction to push either of the two prongs 244A and 244B against a protruding tongue 256 provided on the positioning arm 202 so that the spring 244 contracts and loosens with respect to the inner wall 246. The loosened contact between the spring 244 and the inner wall 246 of the housing 210 allows the spring 244 and the positioning arm 202 to be pushed by the actuator 240 to rotate relative to the housing 210 between the release position and the squeezing position.

While the positioning arm 202 rotates between the release position and the squeezing position, the spring 242 can remain in a state where it contracts and tightens on the output shaft 236 of the speed reducer 216. When the positioning arm 202 reaches the squeezing position, one of the two prongs 242A and 242B can be urged against a stop abutment 258 of the housing 210 (e.g., the stop abutment 258 may be provided in the housing portion 210A) causing the spring 242 to expand and loosen with respect to the output shaft 236 of the speed reducer 216, which allows further rotation of the output shaft 236 while the positioning arm 202 remains in the squeezing position.

Referring to FIGS. 16 and 17, the gear train 220 can couple the output shaft 236 of the speed reducer 216 to the rubbing roller 136. According to an example of construction, the gear train 220 can include a plurality of gears 260, 262 and 264. The gear 260 can be tightly assembled around the output shaft 236 of the speed reducer 216, so that both the gear 260 and the output shaft 236 can rotate in unison. The gears 262 and 264 can be pivotally supported by the positioning arm 202 with the gear 262 respectively meshing with the gears 260 and 264.

The gear 264 can be rotationally coupled to the rubbing roller 136. For example, a connector plug 266 may be restrictedly fitted into the rubbing roller 136, and the gear 264 can be fixedly connected with a rod 268 having a polygonal cross-section that is assembled through a hole of a complementary shape provided on the connector plug 266. Accordingly, the gear 264, the connector plug 266 and the rubbing roller 136 can be assembled with the positioning arm 202 coaxial to the pivot axis P2.

In the aperture control module 200A, a user can actuate the operating member 214 to drive the rotary part 212 in rotation in either direction. As a result, the rotary part 212 can drive the arm actuating assembly 218 in rotation for urging the positioning arm 202 to move between the release and squeezing positions, and in the meantime drive the rubbing roller 136 to rotate relative to the positioning arm 202.

Referring to FIGS. 14-17, the aperture control module 200A can further include a catching part 270 movably assembled with the positioning arm 202, and a spring 271. For example, the catching part 270 may be pivotally supported around the pivot axis P2 of the rubbing roller 136 so that both the catching part 270 and the rubbing roller 136 are rotatable in unison relative to the positioning arm 202. The catching part 270 is movable to engage with a protruding lip 272 provided on the housing 210 (e.g., on the housing portion 210C) to assist in maintaining the positioning arm 202 and the rubbing roller 136 in the squeezing position, and disengage from the protruding lip 272 for movement of the positioning arm 202 from the squeezing position to the release position.

According to an example of construction, the catching part 270 may be provided as a single part having a shaft 274, a protrusion 276 and a tongue 278. The catching part 270 may be pivotally supported around the pivot axis P2 by pivotally assembling the shaft 274 through a shaft portion 280 that is fixedly connected with the gear 264, the shaft portion 280 projecting at a side of the gear 264 opposite to that of the rod 268.

Figure 20:
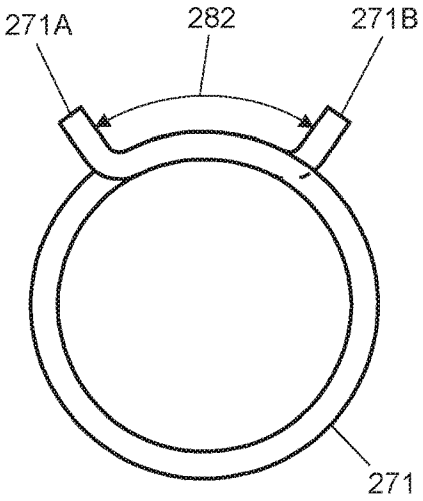
FIGS. 18-20 are schematic views respectively illustrating three springs provided in the aperture control module shown in FIGS. 14 and 15.
Figure 19:
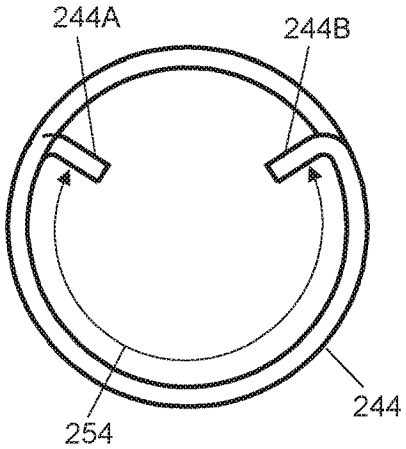
Figure 18:
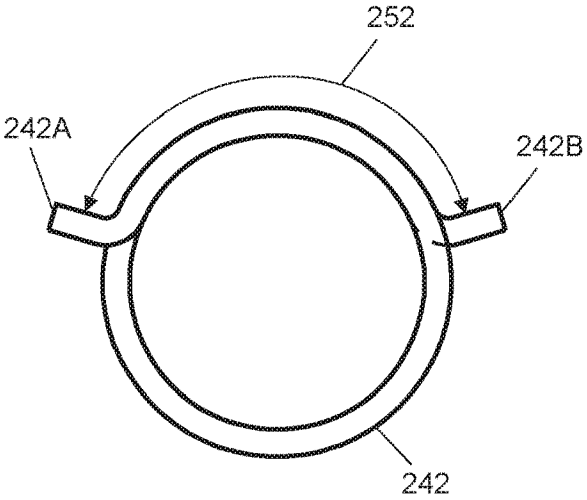

The spring 271 may be a coiled spring, and can be assembled around the shaft portion 280 of the gear 264 in tight contact therewith. FIG. 20 is a schematic view illustrating the spring 271 alone. As shown in FIG. 20, the spring 271 can have two spaced-apart prongs 271A and 271B. Once assembled, the tongue 278 of the catching part 270 can be disposed in a space 282 between the two prongs 271A and 271B of the spring 271, such that a pressure contact between the tongue 278 and either of the two prongs 271A and 271B would urge the spring 271 to further contract and tighten on the shaft portion 280 of the gear 264.

With the aforementioned assembly, the rubbing roller 136, the gear 264, the spring 271 and the catching part 270 can rotate in unison in either direction, and the engagement of the catching part 270 with the protruding lip 272 of the housing 210 can assist in holding the panel assembly 104 in the open state.

Figure 25A:
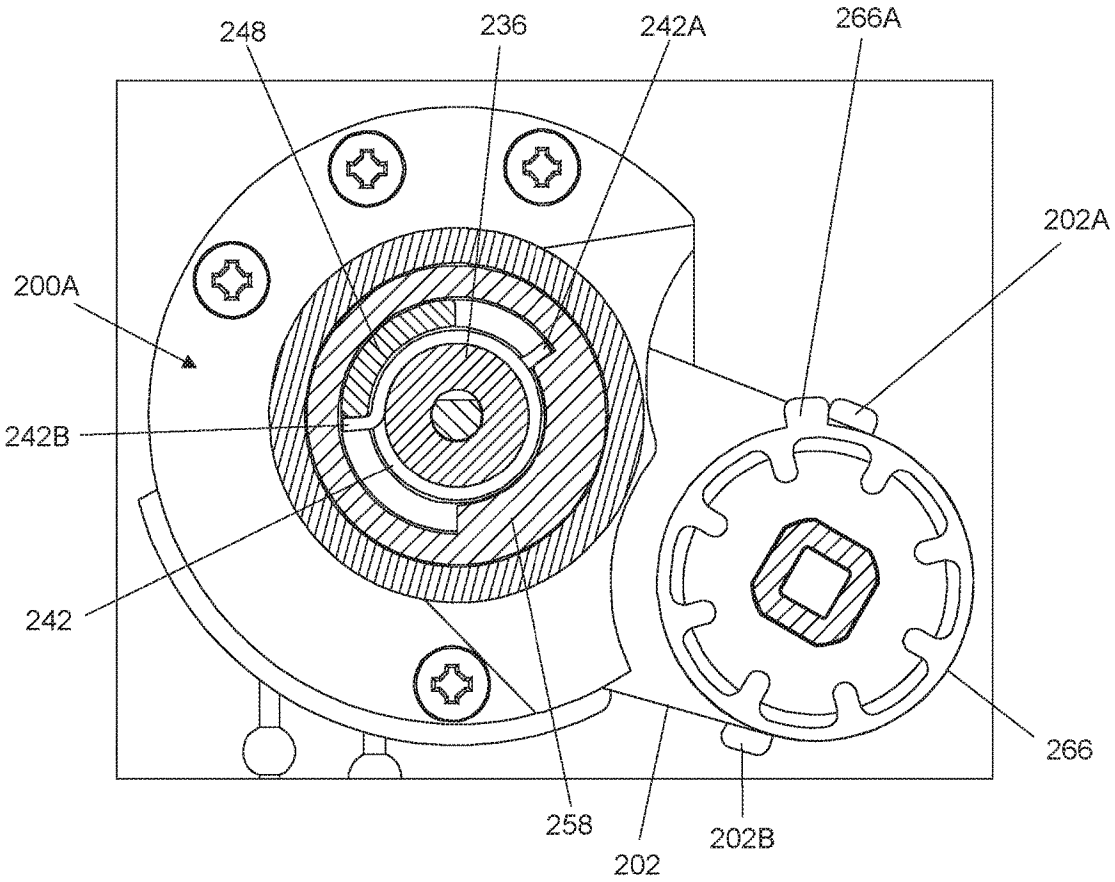
FIGS. 25A-27D are cross-sectional views taken in different section planes illustrating exemplary operation of the aperture control module shown in FIG. 17 when the panel assembly is switched from the closed state to the open state.
Figure 25B:
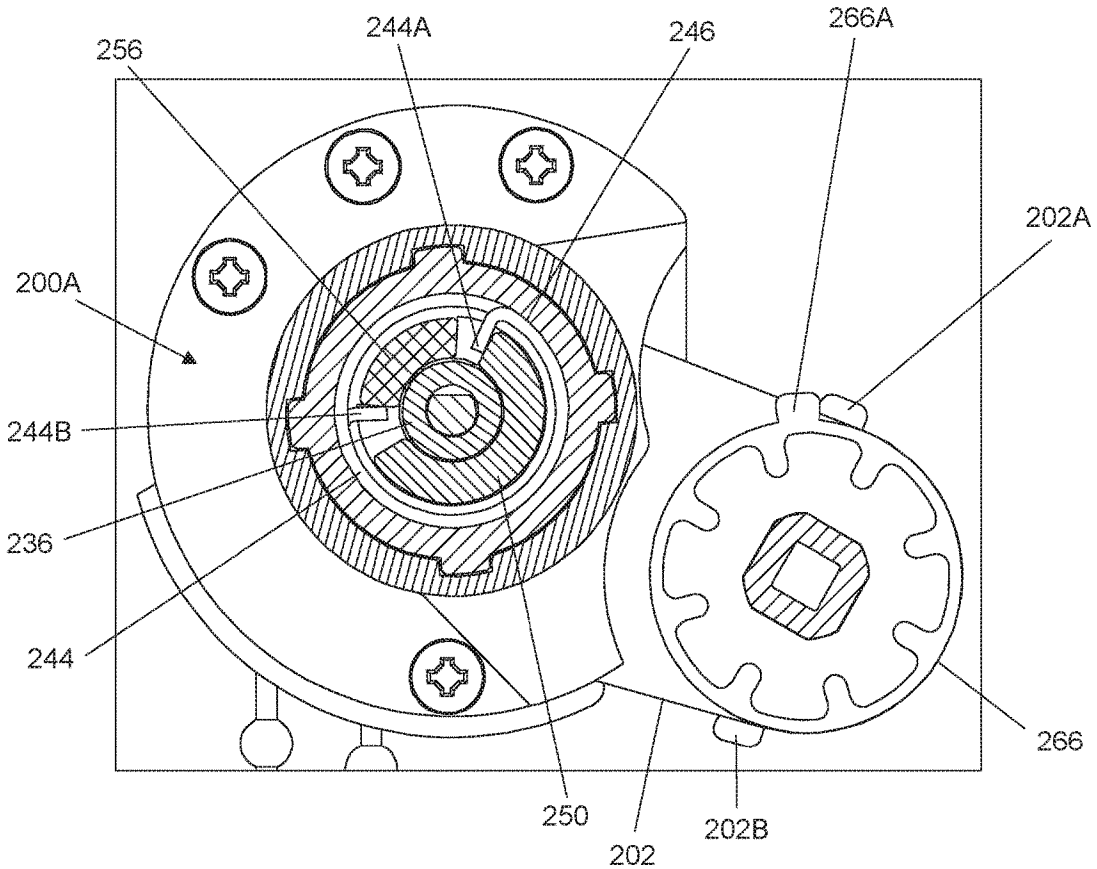
Figure 25C:
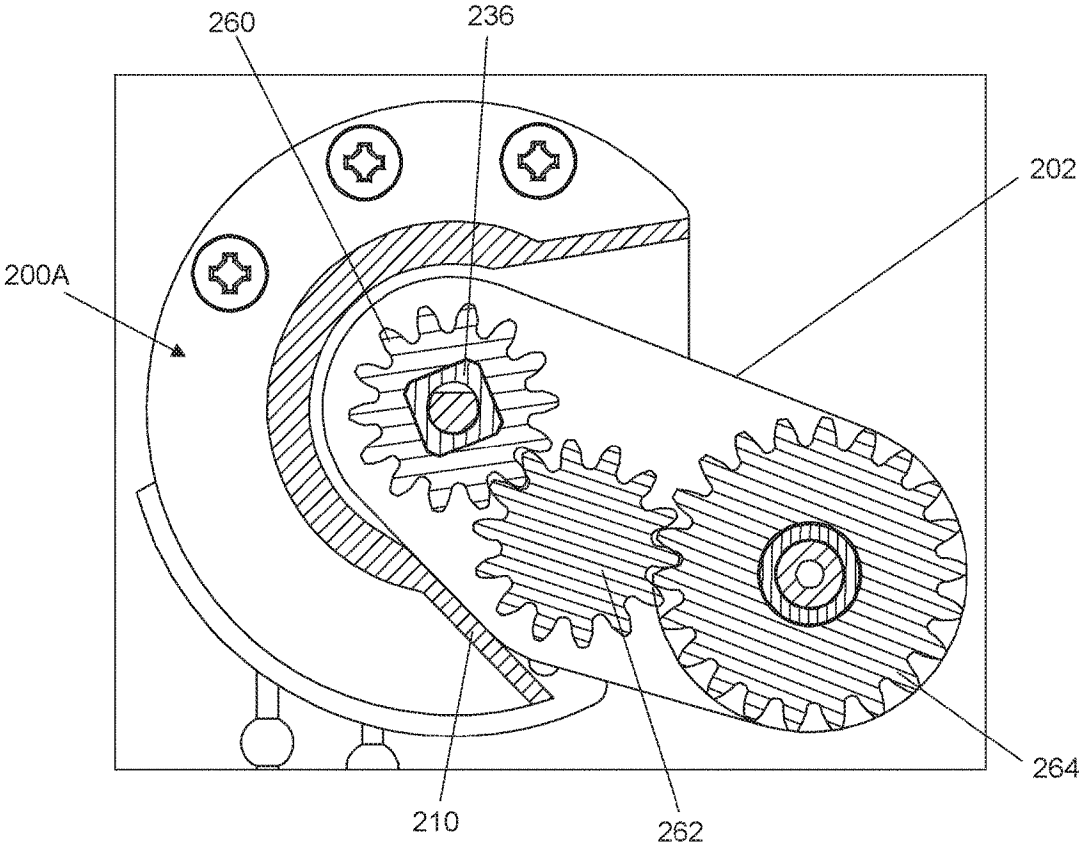
Figure 25D:
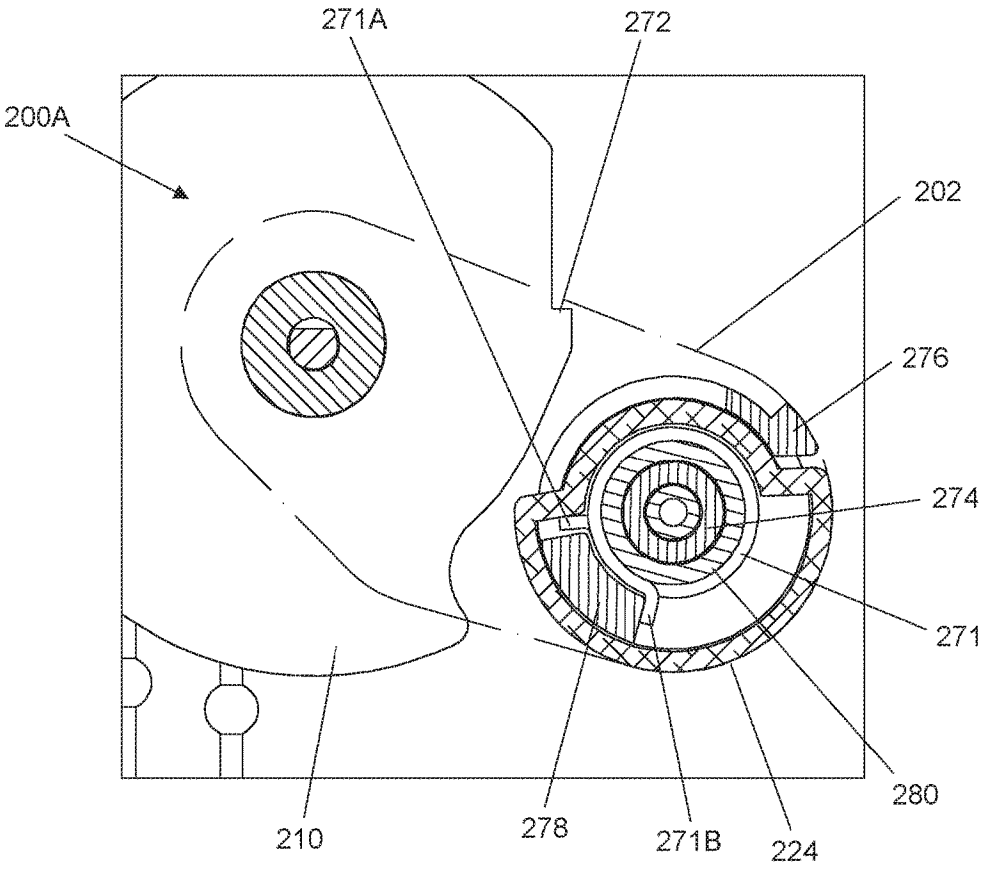
Figure 26A:
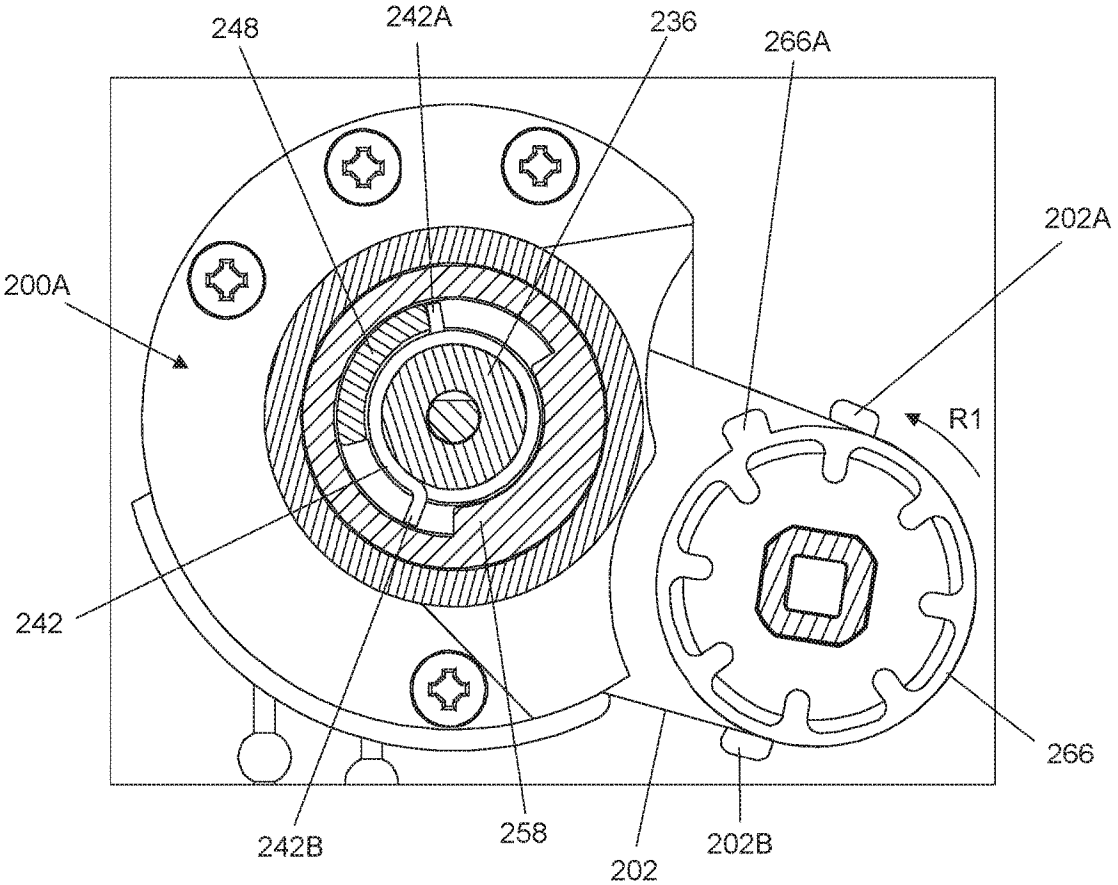
Figure 26B:
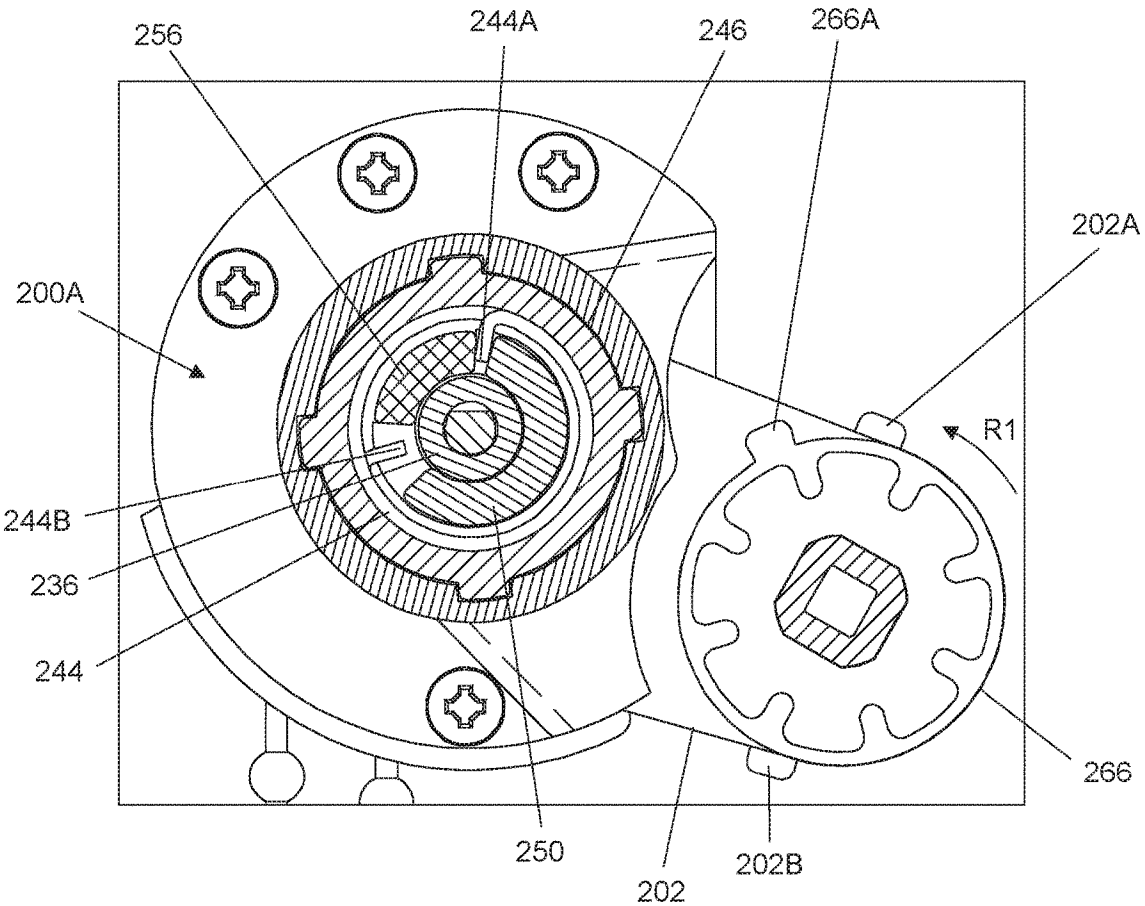
Figure 26C:
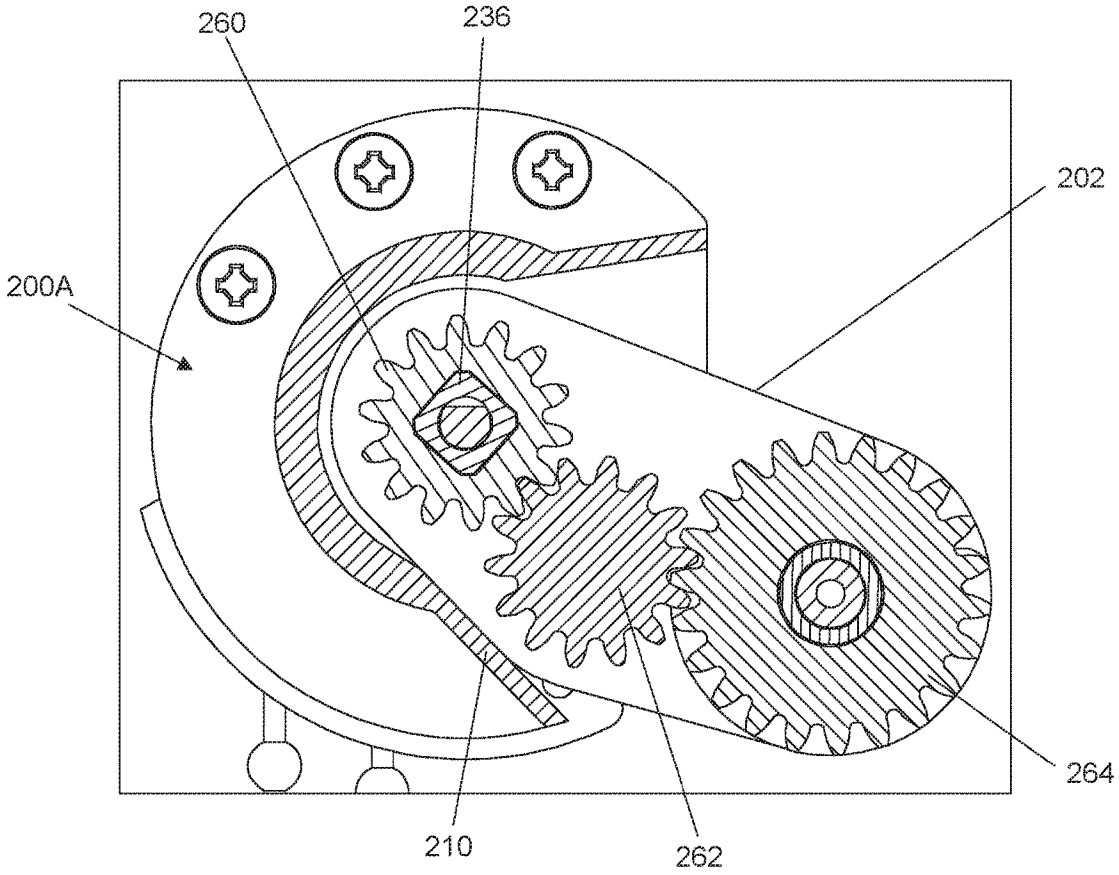
Figure 26D:
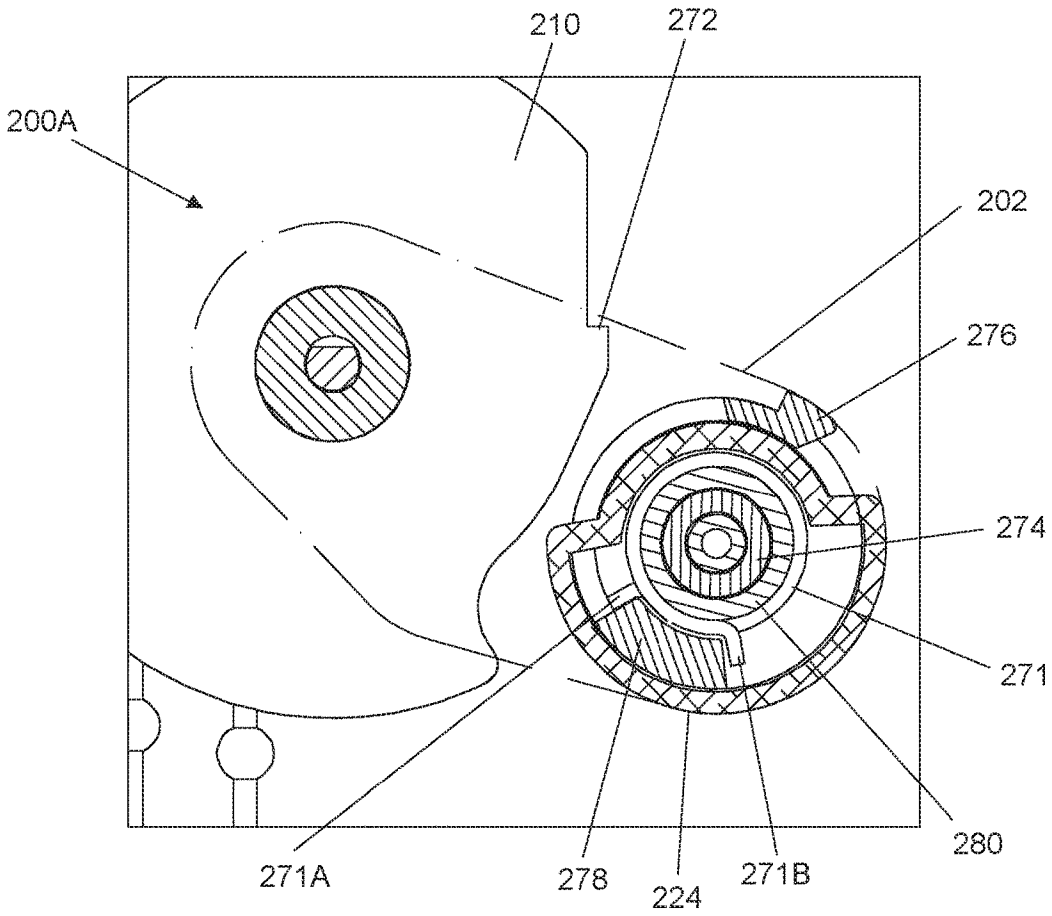
Figure 27A:
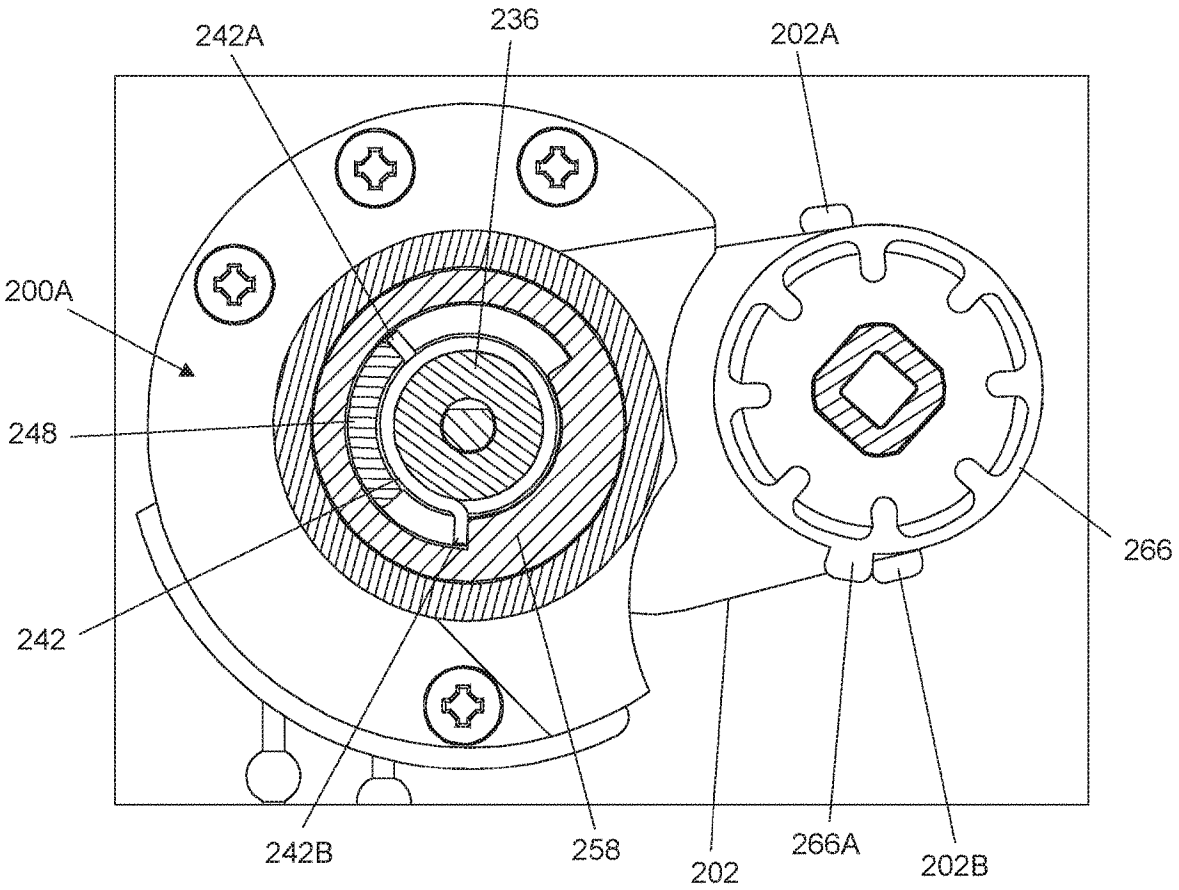
Figure 27B:
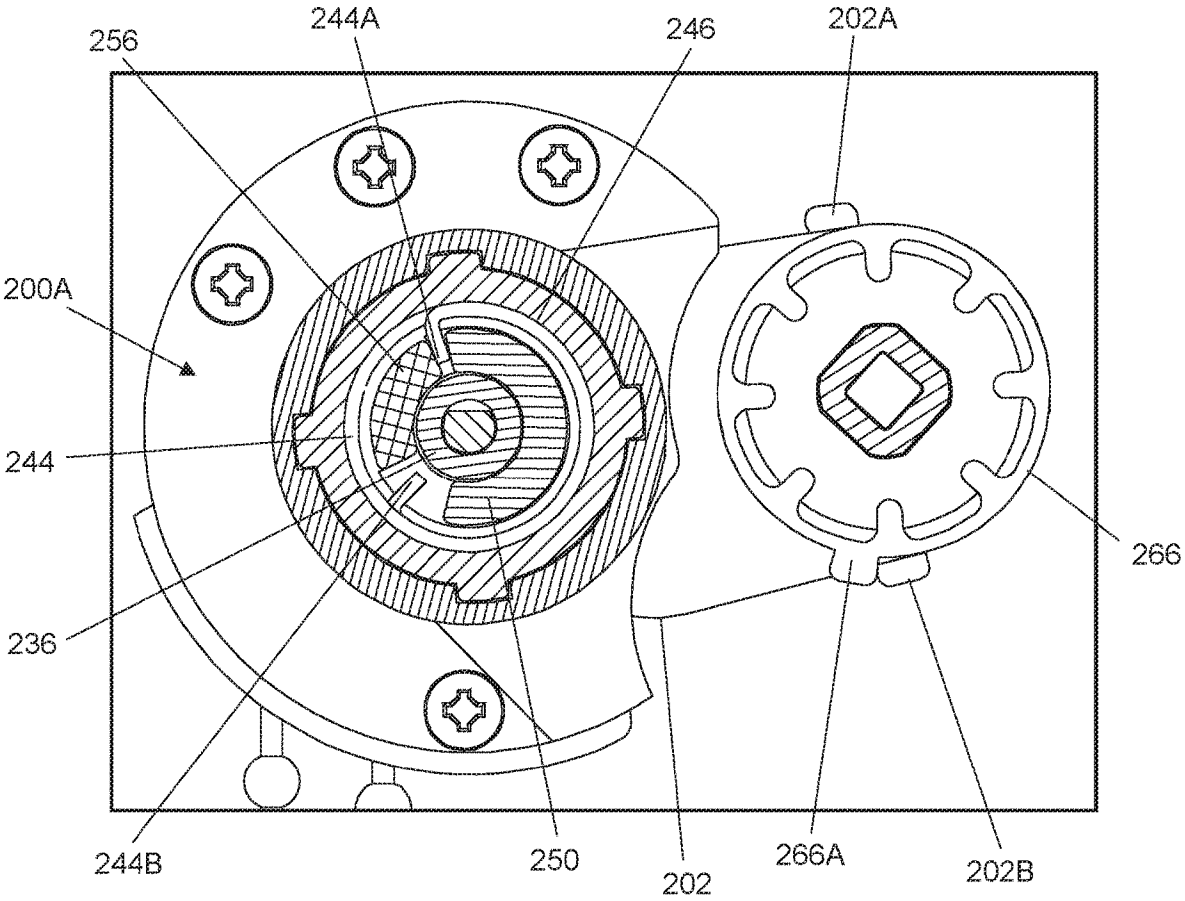
Figure 27C:
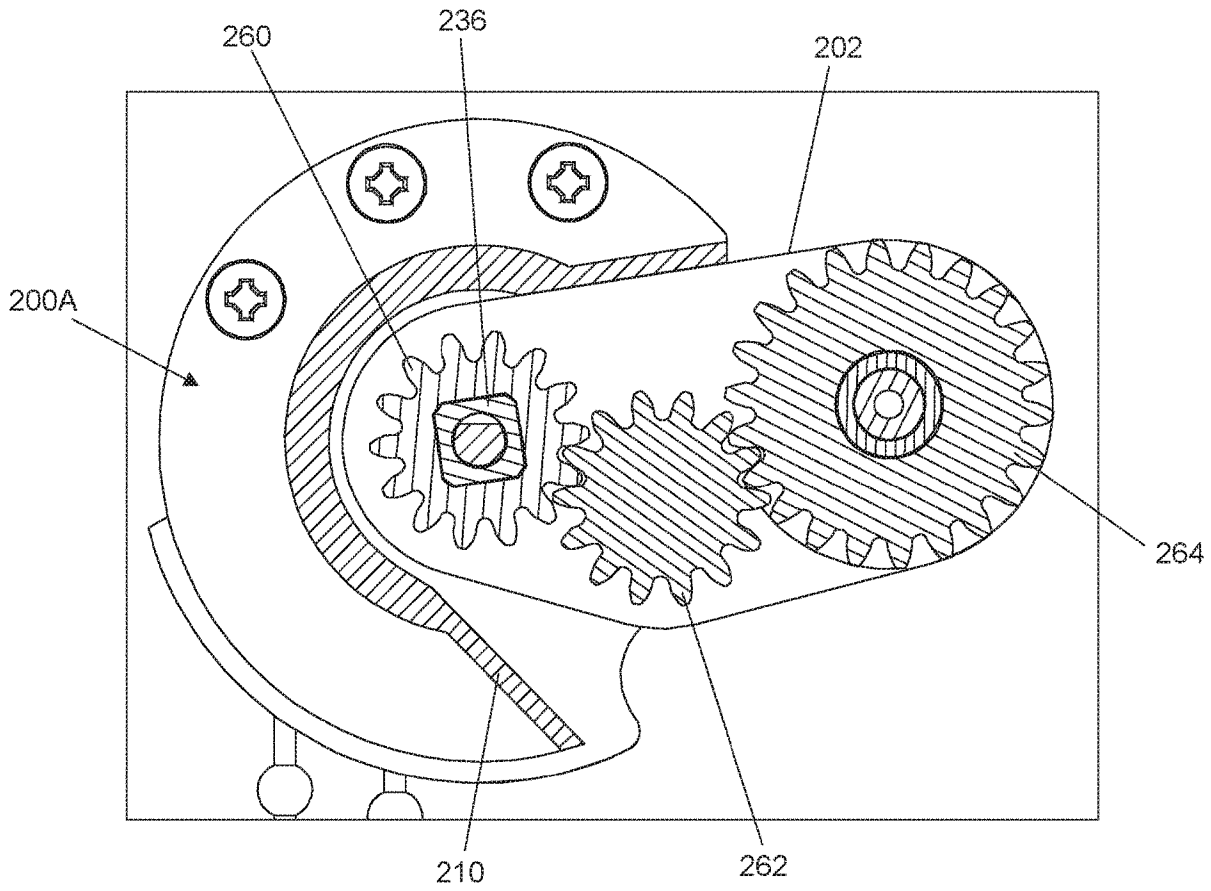
Figure 27D:
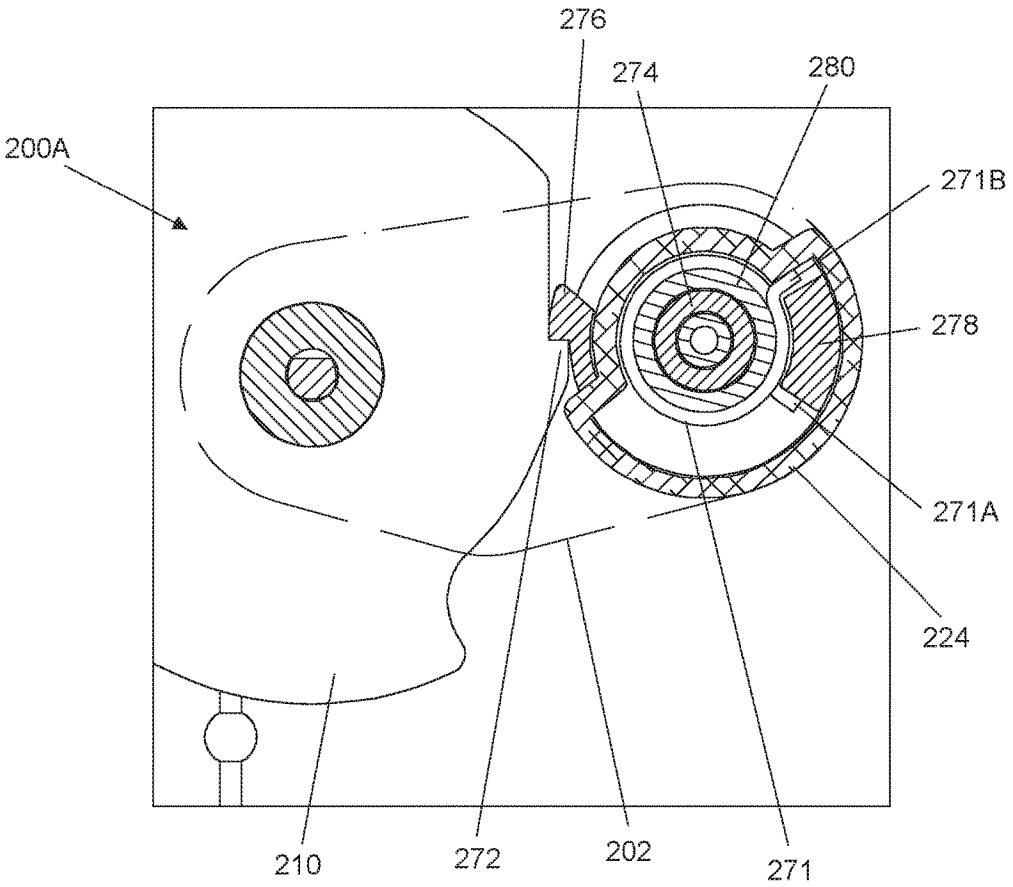
Figure 28A:
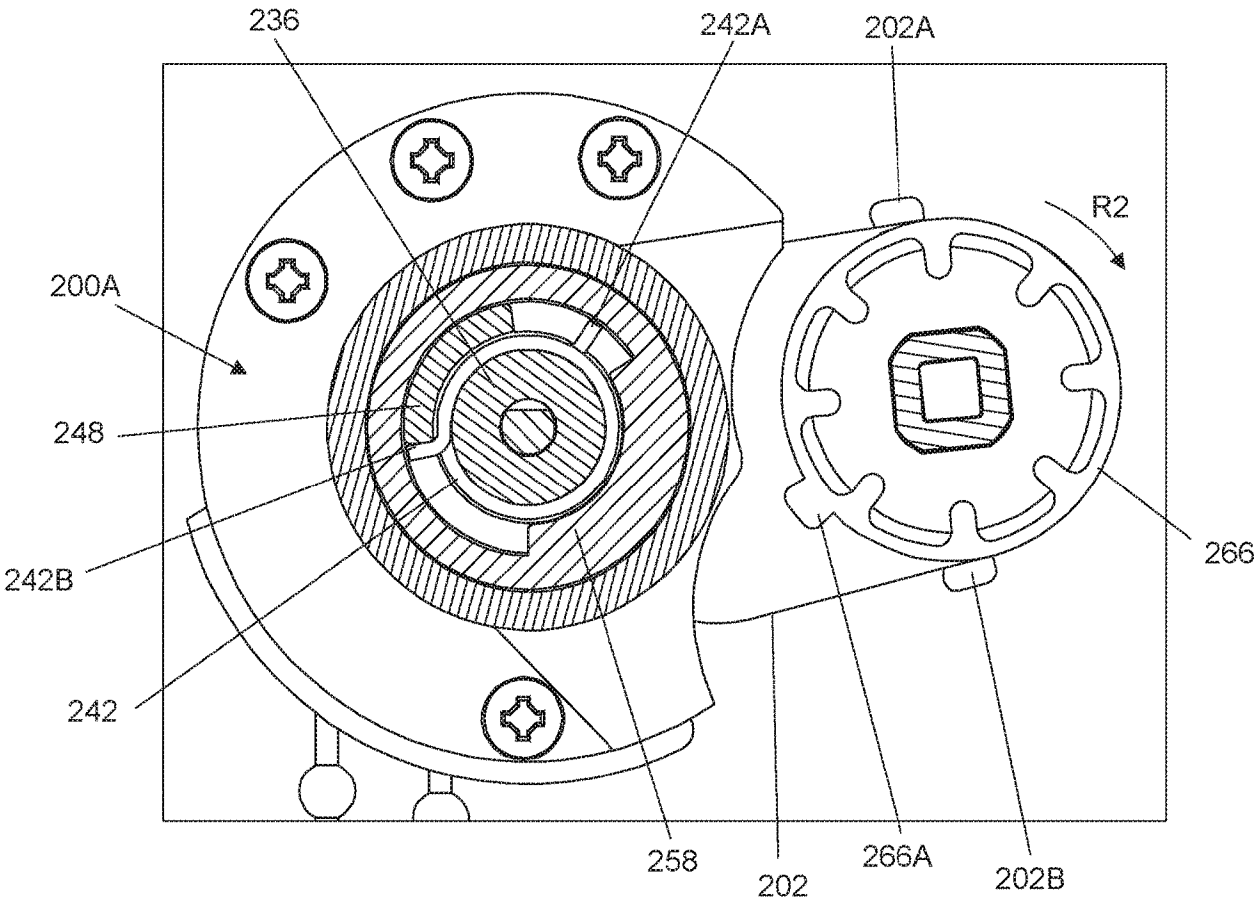
FIGS. 28A-29D are cross-sectional views taken in different section planes illustrating exemplary operation of the aperture control module shown in FIG. 17 when the panel assembly is switched from the open state to the closed state.
Figure 28B:
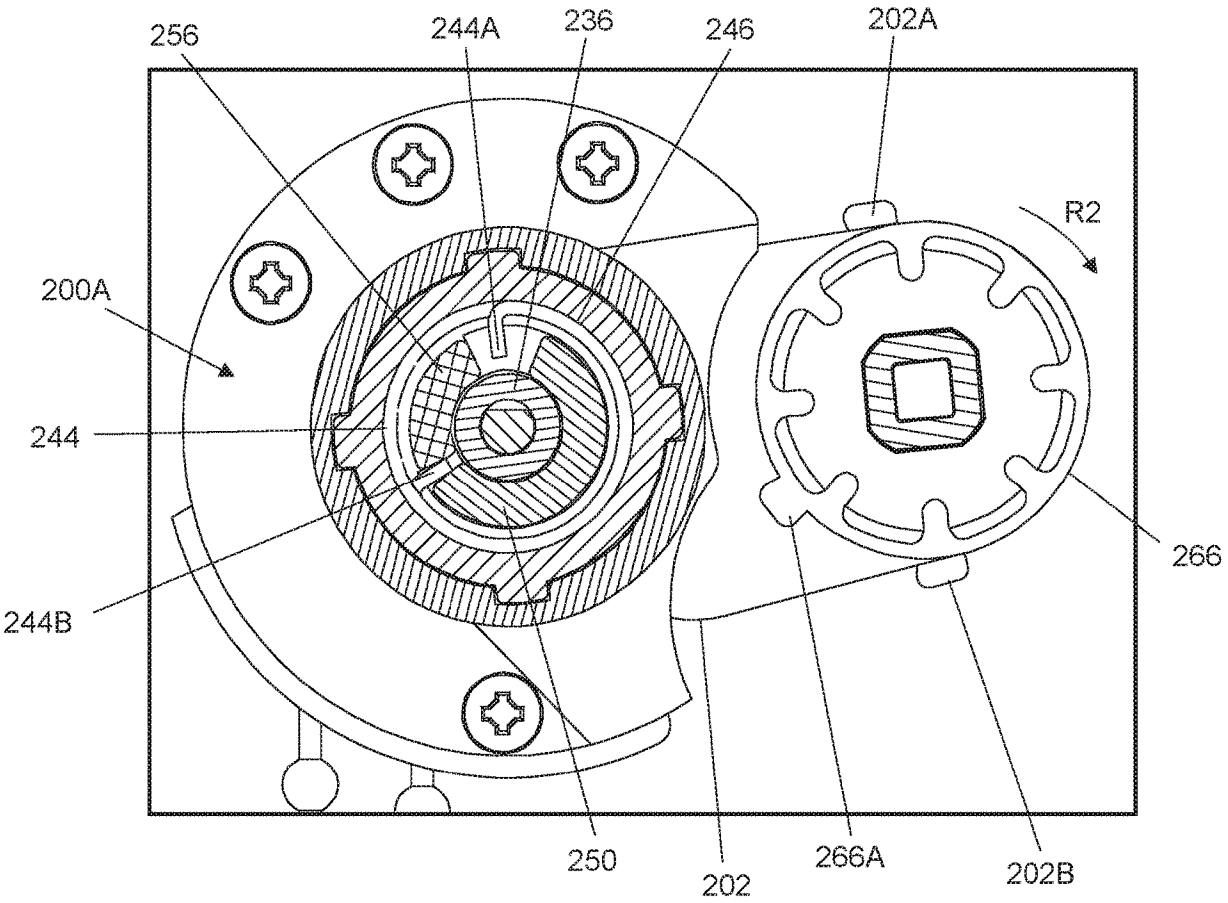
Figure 28C:
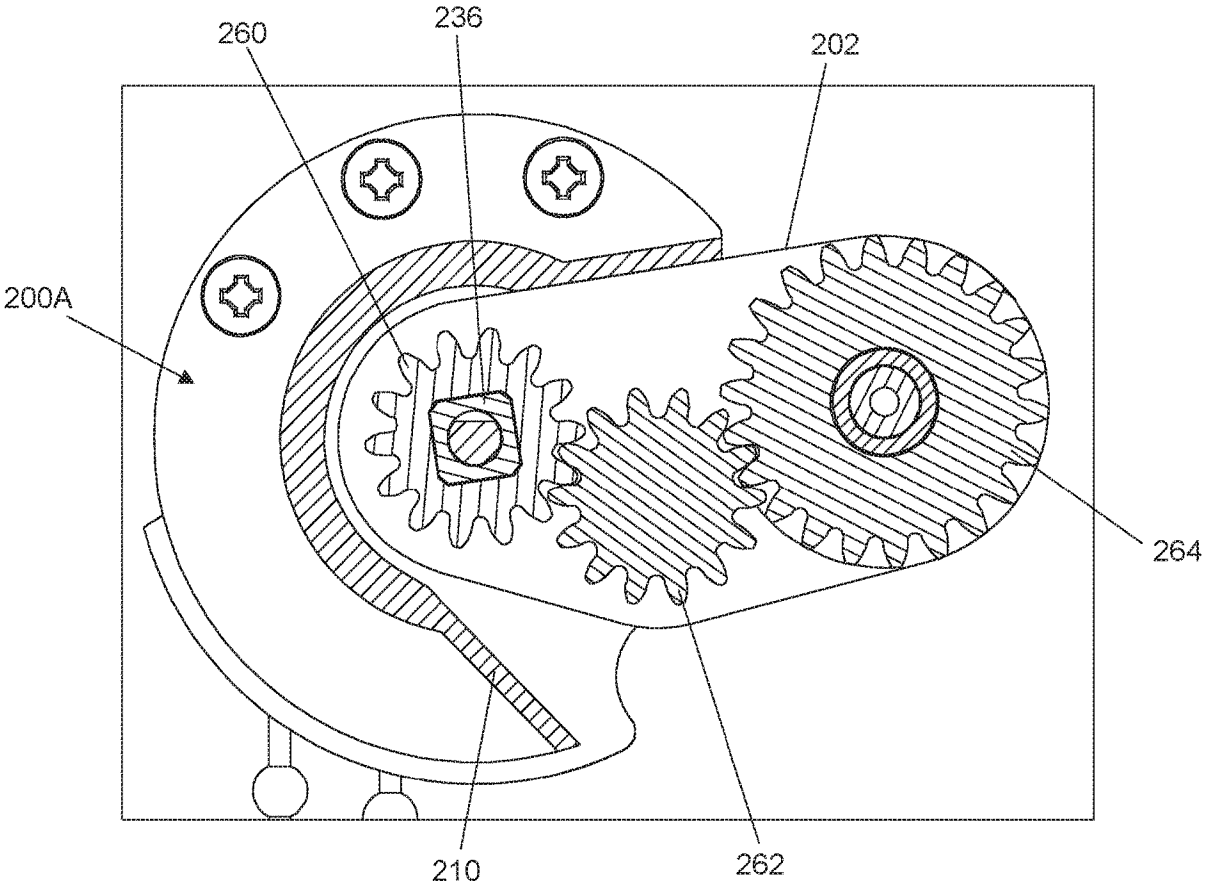
Figure 28D:
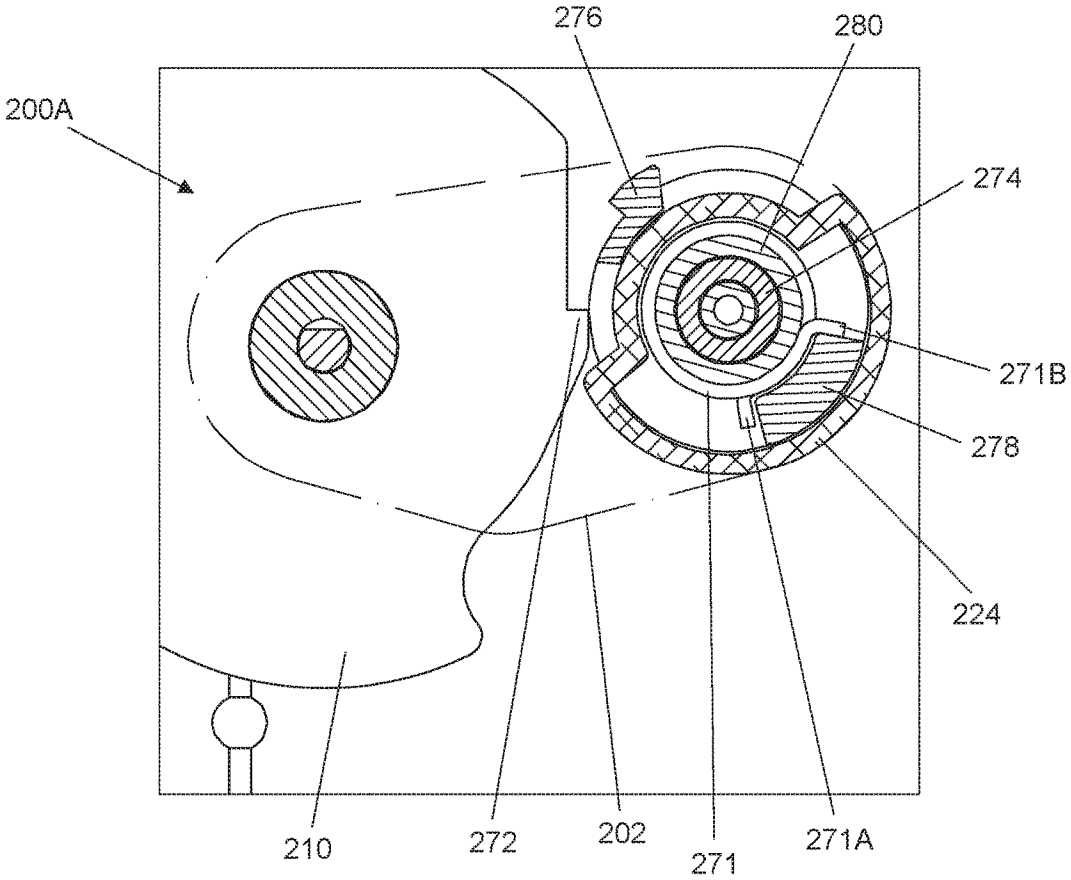
Figure 29A:
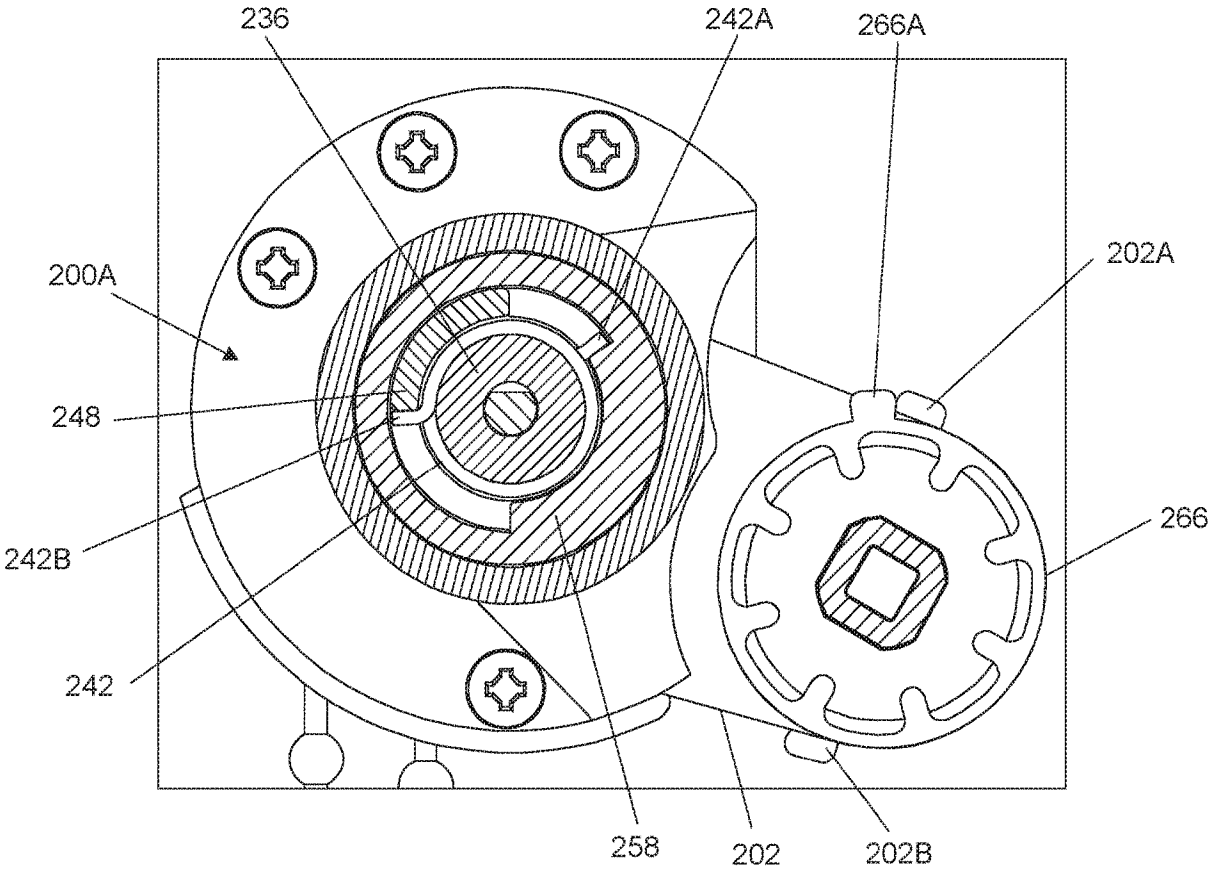
Figure 29B:
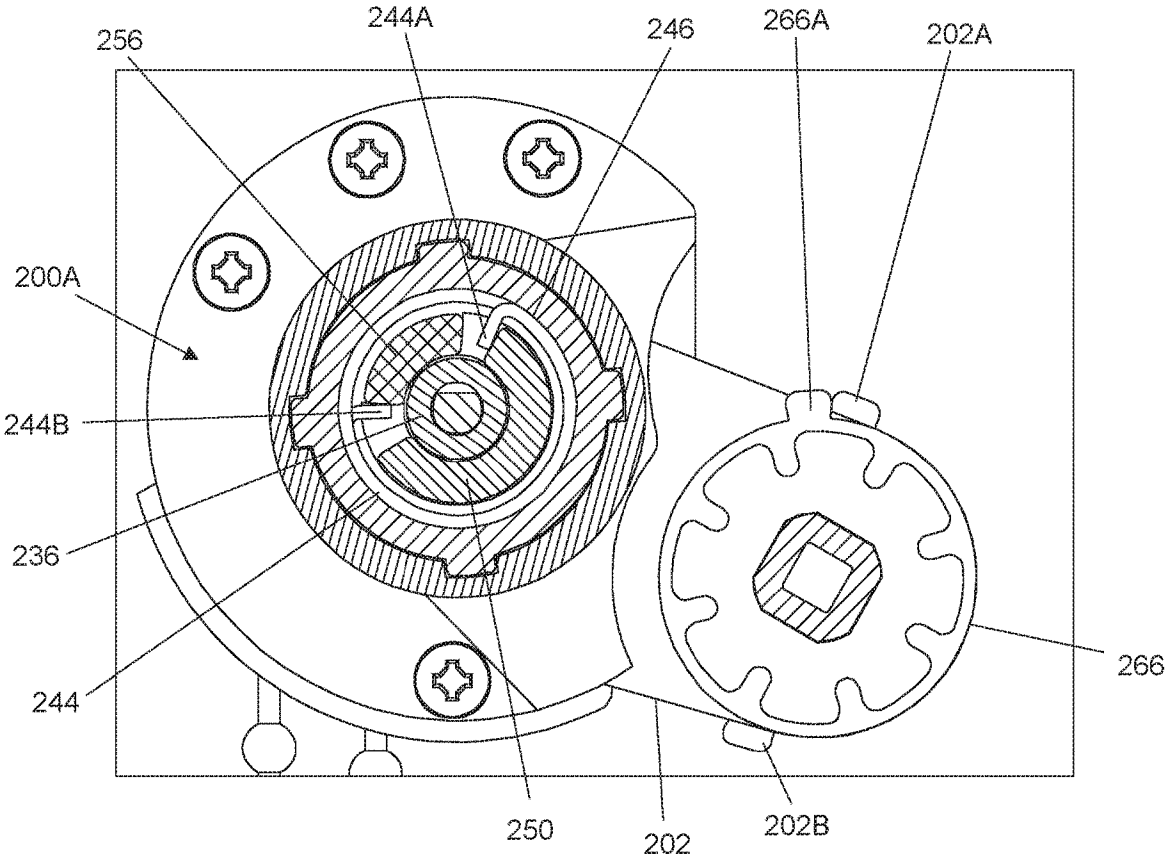
Figure 29C:
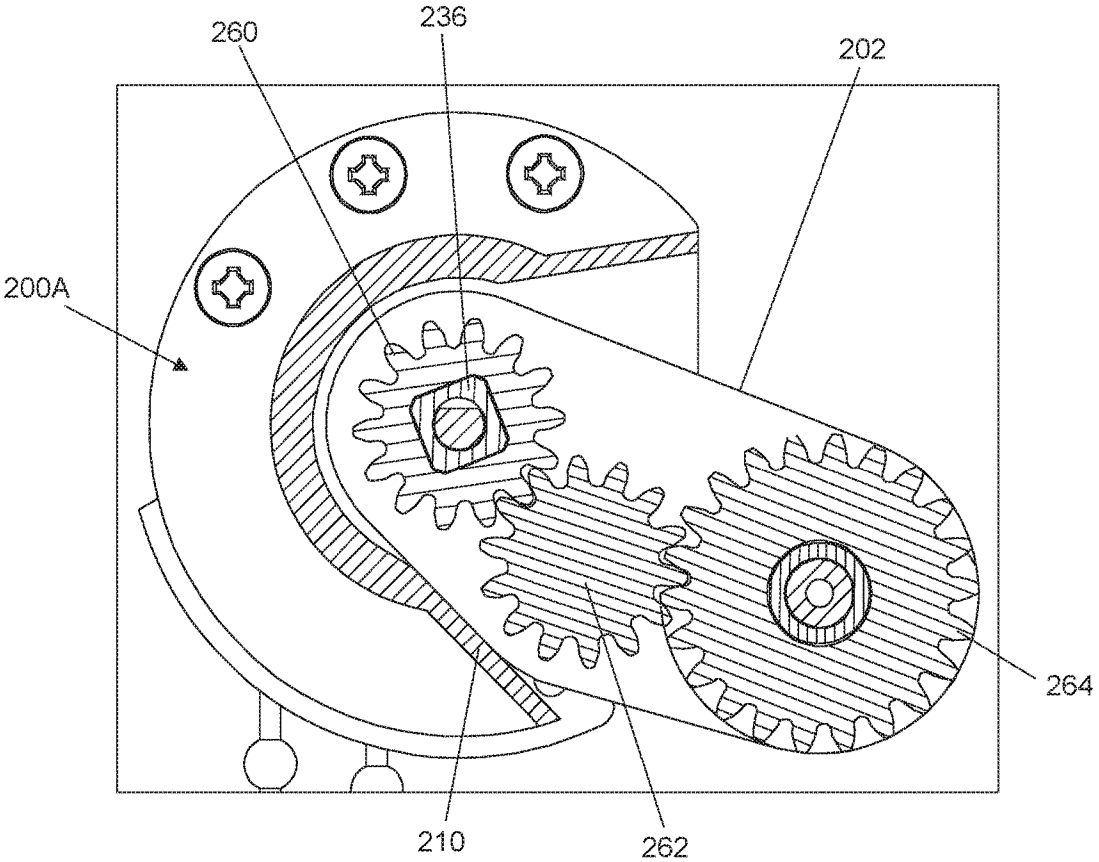
Figure 29D:
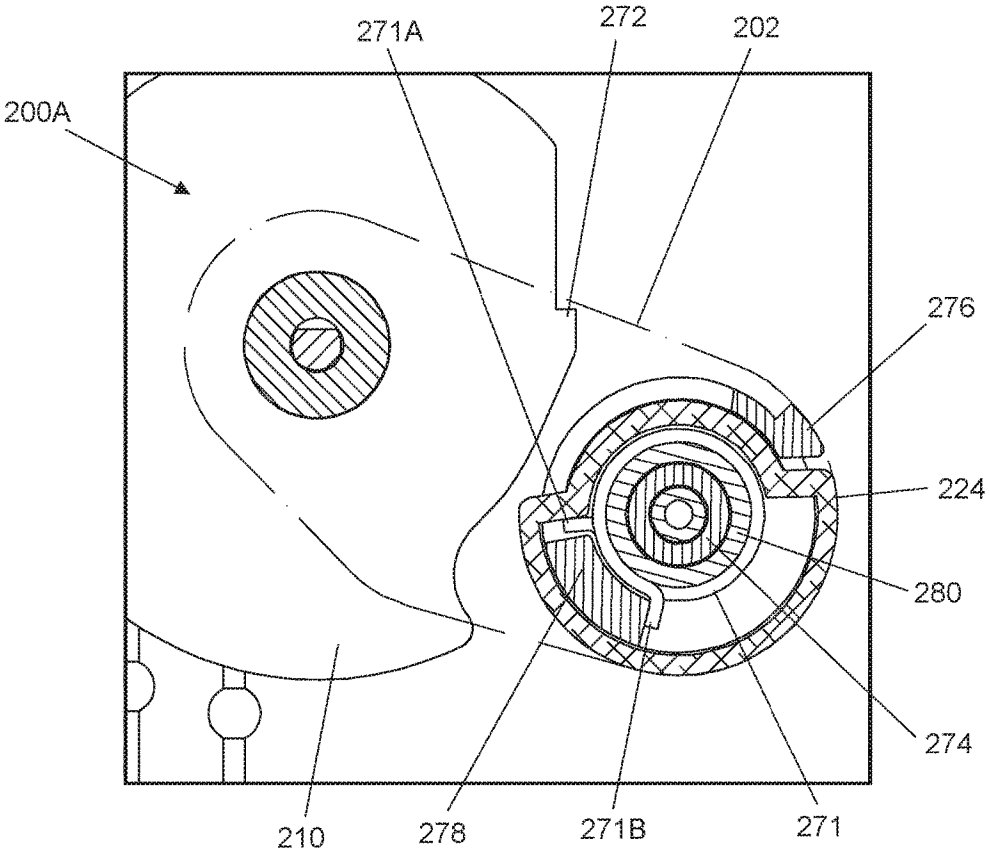

As better shown in FIG. 25A, the positioning arm 202 can further include two stop abutments 202A and 202B that are used to delimit a rotational course of the rubbing roller 136 relative to the positioning arm 202. For example, with reference to FIGS. 17 and 25A, the rubbing roller 136 may be provided with a protrusion 266A (e.g., the protrusion 266A may be formed with the connector plug 266) that is restricted to move between the two stop abutments 202A and 202B. Accordingly, the rotary part 212 can rotate in a first direction until the protrusion 266A provided on the rubbing roller 136 contacts with the stop abutment 202B so that the rotary part 212 is stopped in the open state of the panel assembly 104, and the rotary part 212 can rotate in a second direction opposite to the first direction until the protrusion 266A contacts with the other stop abutment 202A so that the rotary part 212 is stopped in the closed state of the panel assembly 104.

In conjunction with FIGS. 13-20, FIGS. 21-24 are various schematic views illustrating the construction of the aperture control module 200B. Referring to FIGS. 21-24, the aperture control module 200B can have a construction that is very similar to that of the aperture control module 200A described previously, except that the operating member 214 present in the aperture control module 200A is omitted in the aperture control module 200B. Because the aperture control module 200B is provided on the same side as the vertical control module 134, omitting the operating member 214 in the aperture control module 200B can avoid the presence of two operating members at the same side of the head frame 102, which may prevent erroneous operation and interlacing of multiple operating members.

As better shown in FIGS. 4 and 13, the two aperture control modules 200A and 200B can be linked to each other via a linking shaft 284, which can have two opposite ends respectively connected with the respective coupling mounts 234 of the two aperture control modules 200A and 200B. The linking shaft 284 may be enclosed in a sleeve 286. Moreover, the two connector plugs 266 can be likewise linked to each other via another linking shaft 288, which is disposed inside the rubbing roller 136. Owing to the coupling of the linking shafts 284 and 288, the two aperture control modules 200A and 200B can synchronously operate in a same way.

Figure 22:
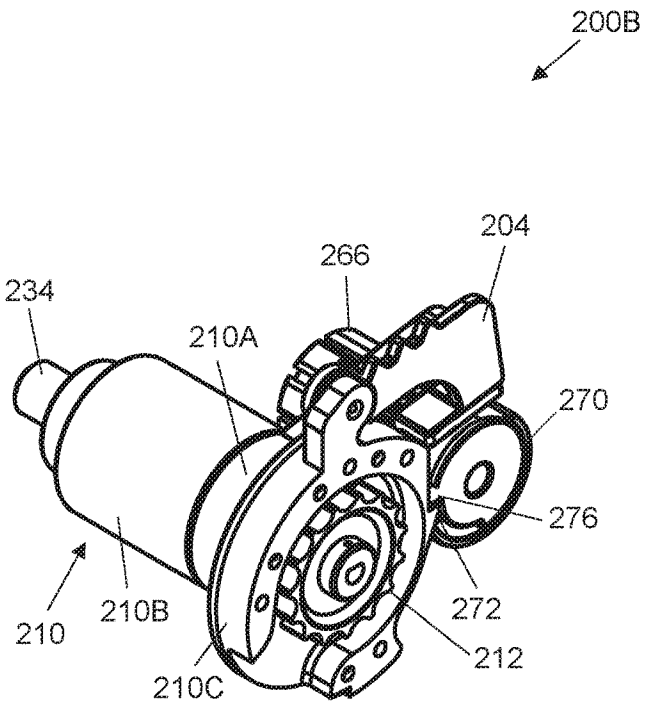
FIGS. 21 and 22 are two perspective views illustrating the other one of the two aperture control modules provided in the window shade.
Figure 21:
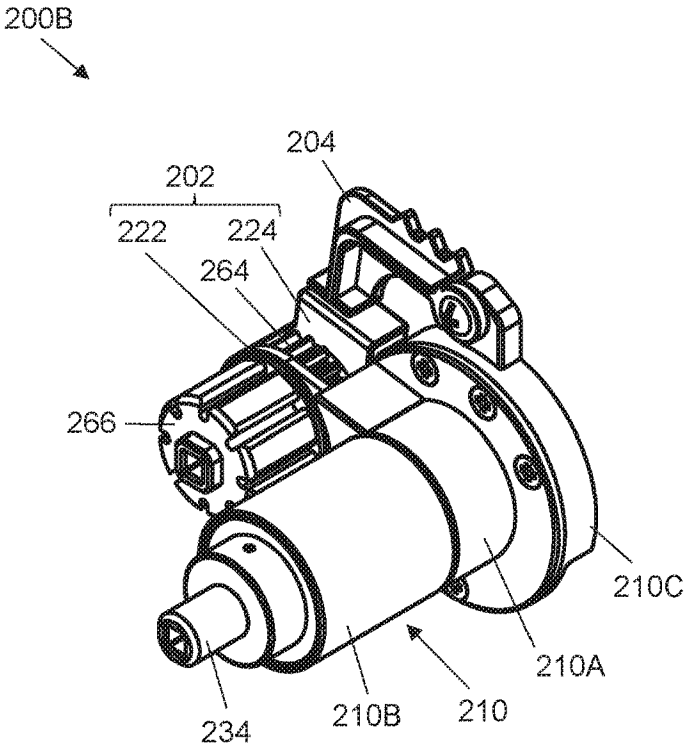
Figure 23:
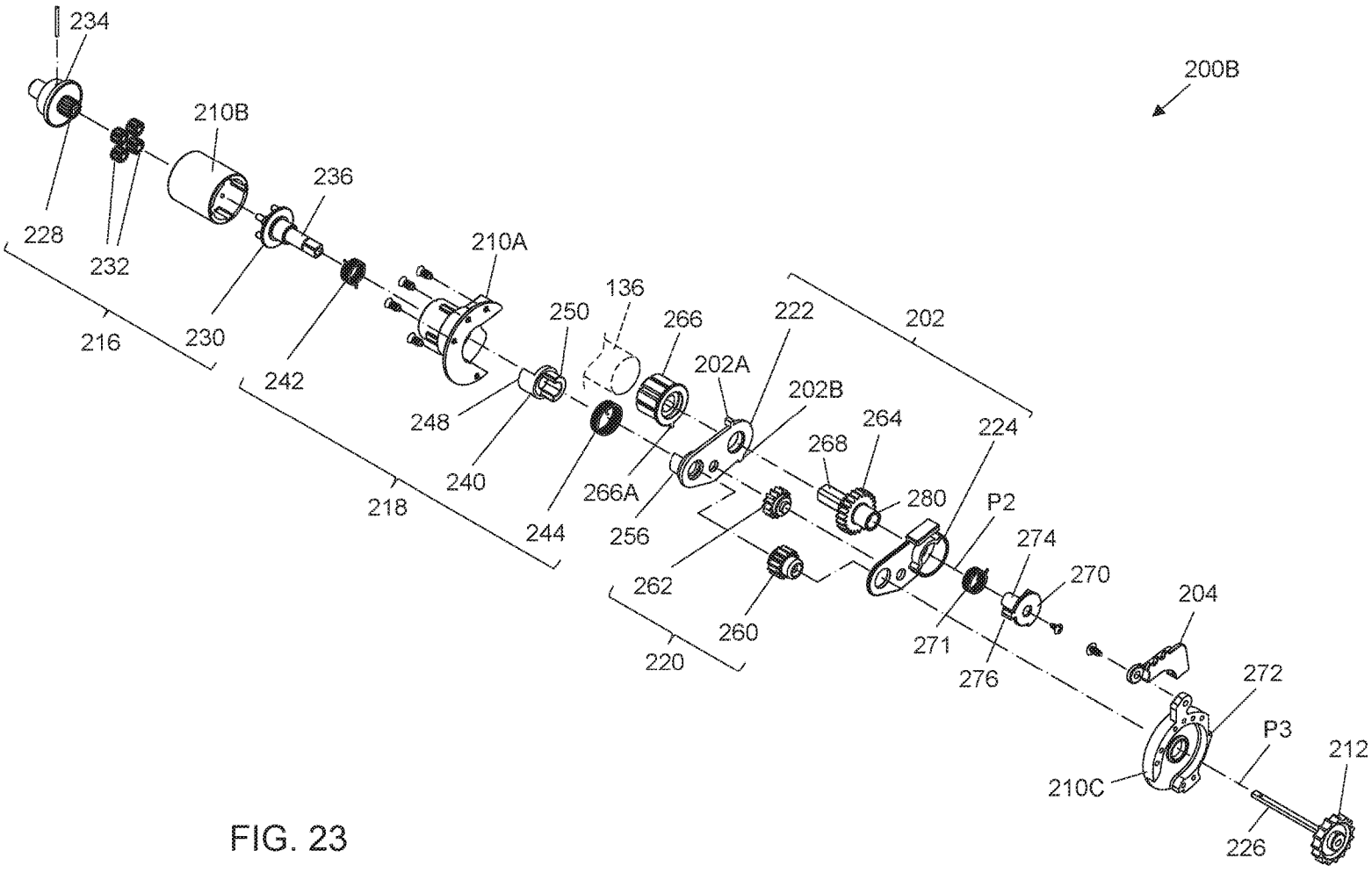
FIG. 23 is an exploded view of the aperture control module shown in FIGS. 21 and 22.
Figure 24:
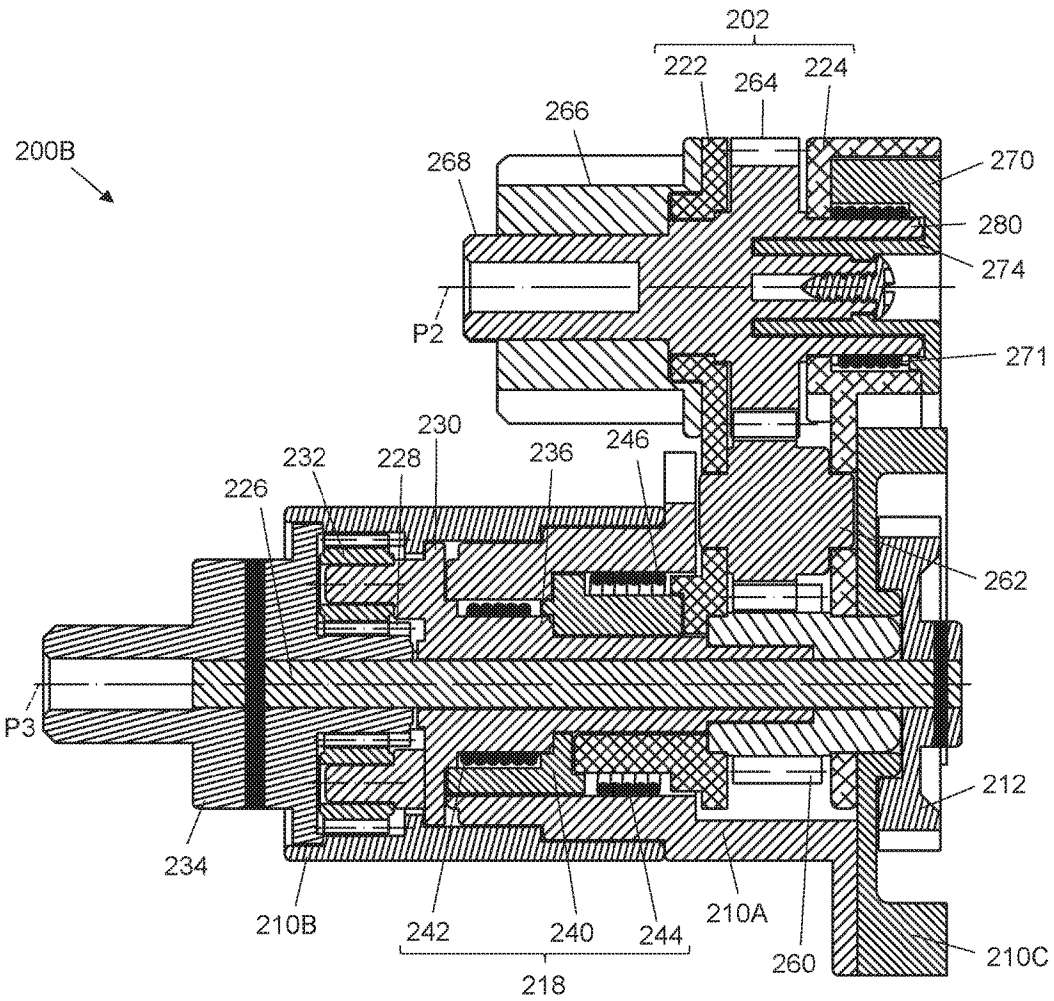
FIG. 24 is a cross-sectional view of the aperture control module shown in FIGS. 21 and 22.

As shown in FIGS. 21-23, the safety lock 204 may be pivotally connected with the housing 210 of the aperture control module 200B adjacent to the positioning arm 202. An upward rotation of the positioning arm 202 of the aperture control module 200B for opening the panel assembly 104 can accordingly cause the positioning arm 202 to push the safety lock 204 upward for engagement with the toothed part 156 (as shown in FIG. 12), and a downward rotation of the positioning arm 202 for closing the panel assembly 104 can allow the safety lock 204 to drop by gravity action and thereby disengage from the toothed part 156 (as shown in FIG. 10).

Each of the two aperture control modules 200A and 200B described herein has a compact structure, and can occupy a relatively small space when it is assembled with the rubbing roller 136 in the head frame 102.

In conjunction with FIGS. 1-4, 9, 11, 16 and 17, FIGS. 25A-27D are cross-sectional views illustrating exemplary operation of the aperture control module 200A when the panel assembly 104 is switched from the closed state to the open state, and FIGS. 28A-29D are cross-sectional views illustrating exemplary operation of the aperture control module 200A when the panel assembly 104 is switched from the open state to the closed state. Among FIGS. 25A-29D, the figure numbers with the suffix "A" (i.e., FIGS. 25A, 26A, 27A, 28A and 29A) are cross-sectional views illustrating partially the aperture control module 200A in different states as observed in the section plane A shown in FIG. 17. The figure numbers with the suffix "B" (i.e., FIGS. 25B, 26B, 27B, 28B and 29B) are cross-sectional views illustrating partially the aperture control module 200A in the different states as observed in the section plane B shown in FIG. 17. The figure numbers with the suffix "C" (i.e., FIGS. 25C, 26C, 27C, 28C and 29C) are cross-sectional views illustrating partially the aperture control module 200A in the different states as observed in the section plane C shown in FIG. 17. The figure numbers with the suffix "D" (i.e., FIGS. 25D, 26D, 27D, 28D and 29D) are cross-sectional views illustrating partially the aperture control module 200A in the different states as observed in the section plane D shown in FIG. 17.

Referring to FIGS. 25A-25D in conjunction with FIGS. 2, 9, 16 and 17, the aperture control module 200A is shown in the release position corresponding to the closed state of the panel assembly 104. In this configuration, the spring 242 can tighten on the output shaft 236 of the speed reducer 216, the spring 244 can be in tight contact with the inner wall 246 of the housing 210, and the spring 271 can tighten on the shaft portion 280 of the gear 264. The protrusion 266A of the connector plug 266 can abut against the stop abutment 202A of the positioning arm 202, which can assist in maintaining the positioning arm 202 in the release position. Moreover, the protrusion 276 of the catching part 270 is disengaged from the protruding lip 272 of the housing 210. While the aperture control module 200A is in the release position, a user can actuate the operating member 110 of the vertical control module 134 (better shown in FIG. 2) to adjust the panel assembly 104 to any desirable height, the panel assembly 104 remaining in the closed state when it is adjusted vertically.

A user can switch the panel assembly 104 between the closed state and the open state at any extended position of the panel assembly 104 below the head frame 102. Referring to FIGS. 26A-26D in conjunction with FIGS. 3, 11, 16 and 17, a user can actuate the operating member 214 of the aperture control module 200A for switching the panel assembly 104 from the closed state to the open state. As a result, the rotary part 212 can rotate and drive the output shaft 236 of the speed reducer 216 and the spring 242 tightening thereon to rotate in unison. This rotation of the output shaft 236 drives the gears 260, 262 and 264 to rotate, which results in the connector plug 266 and the rubbing roller 136 rotating concurrently in a direction R1 that moves the protrusion 266A away from the stop abutment 202A and toward the stop abutment 202B. The spring 271 tightening on the shaft portion 280 of the gear 264 also rotates along with the gear 264, and can push the catching part 270 to rotate in the same direction via a contact between the prong 271A of the spring 271 and the tongue 278 of the catching part 270. Moreover, the rotation of the output shaft 236 and the spring 242 also causes the prong 242A of the spring 242 to push against the tongue 248 of the actuator 240, which urges the actuator 240 to rotate in the same direction. As the actuator 240 rotates, the tongue 250 of the actuator 240 can push the prong 244A of the spring 244 against the tongue 256 of the positioning arm 202, which causes the spring 244 to contract and loosen with respect to the inner wall 246 of the housing 210. The pushing action exerted through the actuator 240 then can cause the actuator 240, the spring 244 and the positioning arm 202 to rotate in contact with one another toward the squeezing position.

Referring to FIGS. 27A-27D in conjunction with FIGS. 3, 11, 16 and 17, once the positioning arm 202 reaches the squeezing position, the prong 242B can contact against the stop abutment 258 of the housing 210, which stops the spring 242, the actuator 240, the spring 244 and the positioning arm 202, and causes the spring 242 to expand and loosen with respect to the output shaft 236 of the speed reducer 216. The spring 242, the actuator 240, the spring 244 and the positioning arm 202 can thereby remain stationary in the squeezing position, while the output shaft 236 of the speed reducer 216 can further rotate driven by the rotary part 212. Owing to the drive transmission via the gears 260, 262 and 264, this further rotation of the output shaft 236 can drive the connector plug 266 and the rubbing roller 136 to continue to rotate in the direction R1 relative to the positioning arm 202, which remains stationary in the squeezing position. As a result, the rubbing roller 136 can urge the panel 116 to slide upward relative to the panel 118 for rotating the transversal vanes 120 and thereby switching the panel assembly 104 to the open state. While the rubbing roller 136 rotates in the direction R1 for opening the panel assembly 104, the protrusion 276 of the catching part 270 can move toward the protruding lip 272 of the housing 210.

The protrusion 266A can abut against the stop abutment 202B of the positioning arm 202 to stop the rotary part 212 and the rubbing roller 136 in the open state of the panel assembly 104 and block further rotation of the rotary part 212. Once the panel assembly 104 is in the open state, the protrusion 276 of the catching part 270 can engage with the protruding lip 272 of the housing 210. This engagement can urge the spring 244 to further frictionally contact with the inner wall 246 of the housing 210, which can assist in keeping the positioning arm 202 in the squeezing position and maintaining the panel assembly 104 in the open state.

For switching the panel assembly 104 from the open state to the closed state, a user can actuate the operating member 214 in a direction opposite to that for opening the panel assembly 104. Referring to 28A-28D in conjunction with FIGS. 2, 16 and 17, the rotary part 212 can accordingly rotate and drive the output shaft 236 of the speed reducer 216 and the spring 242 tightly holding thereon to rotate in unison. This rotation of the output shaft 236 drives the gears 260, 262 and 264 to rotate, which causes the connector plug 266 and the rubbing roller 136 to rotate concurrently in a direction R2 opposite to the direction R1 that moves the protrusion 266A away from the stop abutment 202B and toward the stop abutment 202A. As a result, the rubbing roller 136 can assist to displace the panel 116 downward relative to the panel 118 for closing the panel assembly 104. In the meantime, the spring 271 tightening on the shaft portion 280 of the gear 264 also rotates along with the gear 264, and can push the catching part 270 to rotate in the same direction via a contact between the prong 271B of the spring 271 and the tongue 278 of the catching part 270. As a result, the protrusion 276 of the catching part 270 can disengage from the protruding lip 272 of the housing 210.

The aforementioned rotation of the output shaft 236 and the spring 242 also causes the prong 242B of the spring 242 to push against the tongue 248 of the actuator 240, which urges the actuator 240 to rotate in the same direction. As the actuator 240 rotates, the tongue 250 of the actuator 240 can push the prong 244B of the spring 244 against the tongue 256 of the positioning arm 202, which causes the spring 244 to contract and loosen with respect to the inner wall 246 of the housing 210. The pushing action exerted through the actuator 240 then can cause the actuator 240, the loosened spring 244 and the positioning arm 202 to rotate in contact with one another toward the release position. Accordingly, the panel assembly 104 can be released from the squeezing action of the rubbing roller 136, and recover the closed state owing to the downward force exerted by the weight of the bottom part 106.

Referring to FIGS. 29A-29D in conjunction with FIGS. 9, 16 and 17, once the positioning arm 202 reaches the release position, the prong 242A of the spring 242 can contact against the stop abutment 258 of the housing 210, which stops the spring 242, the actuator 240, the spring 244 and the positioning arm 202, and causes the spring 242 to expand and loosen with respect to the output shaft 236 of the speed reducer 216. While the spring 242, the actuator 240, the spring 244 and the positioning arm 202 remain stationary in the release position, the output shaft 236 of the speed reducer 216 can further rotate driven by the rotary part 212. Owing to the drive transmission via the gears 260, 262 and 264, this further rotation of the output shaft 236 can drive the connector plug 266 and the rubbing roller 136 to further rotate relative to the positioning arm 202, which remains stationary in the release position. The rubbing roller 136 can rotate until it is stopped by the engagement of the protrusion 266A with the stop abutment 202A.

Owing to the coupling of the linking shafts 284 and 288 (better shown in FIG. 13), the two aperture control modules 200A and 200B can synchronously operate in a same way as described previously when the panel assembly 104 is switched between the closed state and the open state. Moreover, as described previously in connection with FIGS. 10 and 12, the rotation of the positioning arm 202 in the aperture control module 200B for opening and closing the panel assembly 104 can cause the safety lock 204 to respectively engage and disengage the toothed part 156. This can prevent unwanted vertical displacement of the panel assembly 104 in the open state.

Figure 30:
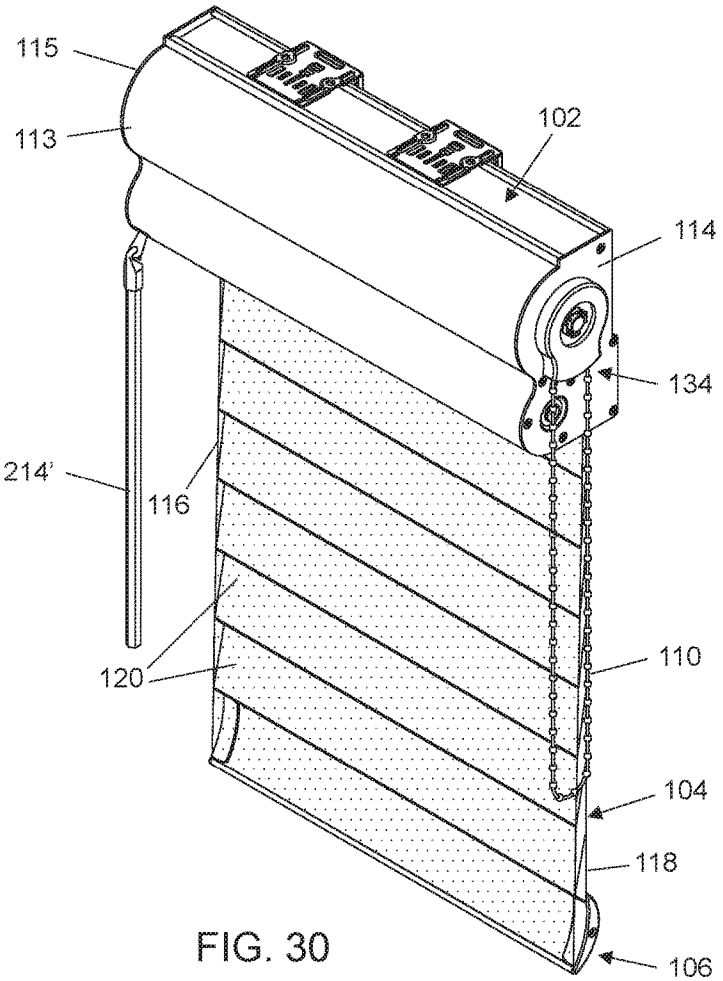
FIGS. 30 and 31 are two perspective views illustrating a variant embodiment of the window shade.
Figure 31:
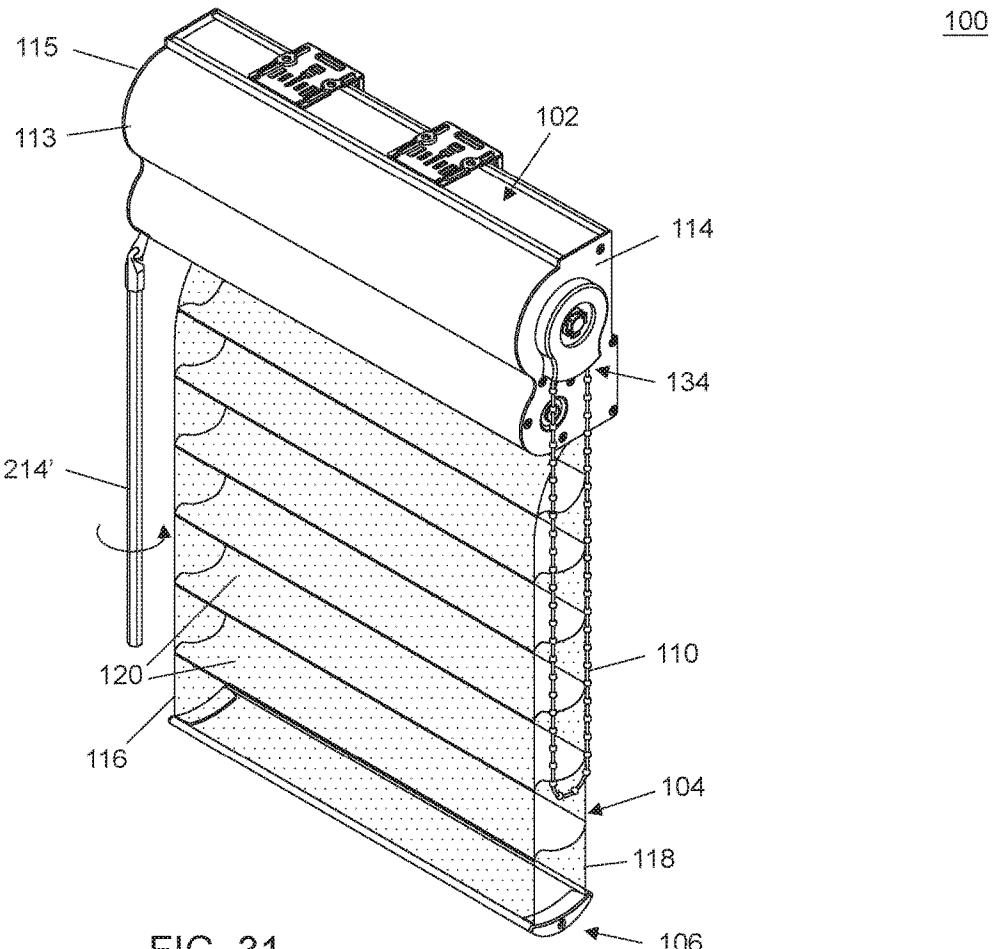

FIGS. 30 and 31 are two perspective views illustrating a variant embodiment of the window shade 100 in which the operating member 214' substitutes for the operating member 214 in the aperture control module 200A described previously. The operating member 214' can be an elongate wand rather than a bead chain. The operating member 214' can be connected with the linking shaft 226 (better shown in FIG. 16) described previously via a gear train (not shown) disposed between the operating member 214' and the linking shaft 226. Other than the operating member 214' and the associated gear train for connection with the linking shaft 226, the window shade 100 shown in FIGS. 30 and 31 can be substantially identical to the window shade 100 previously described.

Advantages of the window shade described herein include the ability to adjust a vertical position of the panel assembly and close and open the panel assembly at any desired height. The vertical displacement of the panel assembly and its switching between the closed and open state can be actuated independently with two different operating members.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A window shade comprising:

a head frame having a sidewall;

a reel pivotally connected with the head frame;

a panel assembly connected with the reel and including a first and a second panel, and a plurality of transversal vanes respectively connected with the first and second panels, the reel being rotatable to wind and unwind the panel assembly, and the panel assembly being switchable between an open state for light passage and a closed state blocking light passage by rotating the transversal vanes; and an aperture control module assembled with the head frame, the aperture control module including a positioning arm that is pivotally connected with a rubbing roller;

wherein the aperture control module is operable to rotate the rubbing roller relative to the positioning arm and to displace the positioning arm and the rubbing roller relative to the head frame between a first and a second position, the rubbing roller being displaced away from the sidewall in the first position and pressing the panel assembly against the sidewall in the second position, the rubbing roller being further rotatable relative to the positioning arm in the second position to cause relative sliding between the first and second panels for switching the panel assembly from the closed state to the open state.

2. The window shade according to claim 1, wherein the aperture control module is operable to displace the positioning arm relative to the head frame and rotate the rubbing roller relative to the positioning arm in a concurrent manner.

3. The window shade according to claim 2, wherein the rubbing roller rotates in one direction while the positioning arm moves from the first position to the second position, and in an opposite direction while the positioning arm moves from the second position to the first position.

4. The window shade according to claim 1, wherein the aperture control module is operable to rotate the rubbing roller in one direction while the positioning arm is displaced from the first position to the second position, and to further rotate the rubbing roller in the same direction while maintaining the positioning arm in the second position for switching the panel assembly from the closed state to the open state.

5. The window shade according to claim 1, further including a safety lock disposed adjacent to the aperture control module, and a toothed part rotationally coupled with the reel, the safety lock being engaged with the toothed part to block rotation of the reel when the positioning arm is in the second position, and the safety lock being disengaged from the toothed part for rotation of the reel when the positioning arm is in the first position.

6. The window shade according to claim 5, wherein a movement of the positioning arm from the first position to the second position brings the safety lock in engagement with the toothed part, and a movement of the positioning arm from the second position to the first position disengages the safety lock from the toothed part.

7. The window shade according to claim 1, wherein the aperture control module includes:

a housing fixedly connected with the head frame, the positioning arm being pivotally connected with the housing about a pivot axis;

a speed reducer assembled with the housing and having an output shaft;

an arm actuating assembly connected with the output shaft of the speed reducer, the arm actuating assembly being rotatable about the pivot axis of the positioning arm;

a gear train coupling the output shaft of the speed reducer to the rubbing roller; and a rotary part pivotally connected with the housing and coupled to the speed reducer;

wherein the rotary part is rotatable to drive the rubbing roller to rotate relative to the positioning arm, and to drive the arm actuating assembly in rotation for urging the positioning arm to move between the first and second positions.

8. The window shade according to claim 7, wherein the arm actuating assembly includes an actuator, a first and a second spring, the first spring being tightly assembled around the output shaft of the speed reducer and having two first prongs, the second spring being assembled adjacent to the positioning arm and having two second prongs, and the actuator being pivotally supported around the pivot axis of the positioning arm, the actuator and the first and second springs being rotatable in unison contacting with one another for urging the positioning arm to move between the first and second positions.

9. The window shade according to claim 8, wherein the second spring is assembled in a cavity of the housing with an outer circumference of the second spring tightly contacting with an inner wall of the cavity, the actuator being movable to push any of the two second prongs against a protruding tongue provided on the positioning arm and cause the second spring to contract and loosen with respect to the inner wall, the actuator, the second spring and the positioning arm being thereby rotatable in contact with one another between the first and second positions under a pushing action exerted through the actuator.

10. The window shade according to claim 8, wherein the first spring contracts and tightens on the output shaft while the positioning arm rotates between the first and second positions, and one of the two first prongs is urged against a stop abutment of the housing causing the first spring to expand and loosen with respect to the output shaft when the positioning arm reaches the second position.

11. The window shade according to claim 10, wherein while the positioning arm is in the second position and the actuator and the first and second springs remain stationary with the first spring contacting with the stop abutment of the housing, the output shaft is further rotatable to drive the rubbing roller in rotation relative to the positioning arm.

12. The window shade according to claim 7, wherein the aperture control module further includes a catching part movably assembled with the positioning arm, the catching part being engaged with a protruding lip provided on the housing to assist in maintaining the positioning arm and the rubbing roller in the second position, and the catching part being movable relative to the positioning arm to disengage from the protruding lip for movement of the positioning arm from the second position to the first position.

13. The window shade according to claim 12, wherein the rubbing roller is pivotally connected with the positioning arm about a second pivot axis, and the catching part is pivotally supported around the second pivot axis, the catching part being rotatable in unison with the rubbing roller.

14. The window shade according to claim 13, wherein the gear train includes a gear that is fixedly connected with a shaft portion and is assembled with the positioning arm coaxial to the rubbing roller, and the aperture control module further includes a third spring assembled around the shaft portion, the rubbing roller, the third spring and the catching part being rotatable in unison along with the gear.

15. The window shade according to claim 7, wherein the speed reducer includes a planetary gear train including a central gear rotationally coupled with the rotary part, and a carrier pivotally supporting a plurality of planetary gears respectively meshed with the central gear, the output shaft being fixedly connected with the carrier.

16. The window shade according to claim 7, wherein the positioning arm has a first and a second stop abutment, the rotary part is rotatable in a first direction until a protrusion provided on the rubbing roller contacts with the first stop abutment so that the rotary part is stopped in the open state of the panel assembly, and the rotary part is rotatable in a second direction opposite to the first direction until the protrusion contacts with the second stop abutment so that the rotary part is stopped in the closed state of the panel assembly.

17. The window shade according to claim 7, wherein the aperture control module further includes an operating member that is connected with the rotary part and extends outside the head frame for manual operation.

18. The window shade according to claim 17, wherein the operating member is a bead chain or an elongate wand.

19. The window shade according to claim 1, wherein the rubbing roller is raised upward when the positioning arm moves from the first position to the second position.

20. The window shade according to claim 1, further including a vertical control module coupled with the reel, the vertical control module including a bead chain and being operable independent from the aperture drive system to drive the reel in rotation for winding and unwinding the panel assembly.

* * * * *